US006948745B2

(12) United States Patent
Chevalier

(10) Patent No.: US 6,948,745 B2
(45) Date of Patent: Sep. 27, 2005

(54) LATCH ARRANGEMENTS FOR AUTOMOTIVE DOORS OR OTHER CLOSURES

(76) Inventor: John Phillip Chevalier, 1 Nash House, 18 Park Village East, London NW1 7PY (GB)

( * ) Notice: Subject to any disclaimer, the term of this patent is extended or adjusted under 35 U.S.C. 154(b) by 0 days.

(21) Appl. No.: 09/993,794

(22) Filed: Nov. 23, 2001

(65) Prior Publication Data

US 2002/0121784 A1 Sep. 5, 2002

Related U.S. Application Data

(63) Continuation of application No. 09/372,912, filed on Aug. 12, 1999, now Pat. No. 6,386,599.

(30) Foreign Application Priority Data

Dec. 12, 1997 (WO) ..... PCT/GB97/03434

(51) Int. Cl.[7] ..... E05C 3/06
(52) U.S. Cl. ..... 292/201; 292/216
(58) Field of Search ..... 292/201, 216, 292/DIG. 23; 49/280

(56) References Cited

U.S. PATENT DOCUMENTS

| | | | | |
|---|---|---|---|---|
| 4,223,927 A | | 9/1980 | Kobayashi et al. | |
| 4,502,718 A | | 3/1985 | Sasaki et al. | |
| 4,762,348 A | | 8/1988 | Matsumoto | |
| 4,763,936 A | * | 8/1988 | Rogakos | 292/201 |
| 4,948,183 A | | 8/1990 | Yamada | |
| 4,966,266 A | | 10/1990 | Yamada et al. | |
| 5,088,347 A | | 2/1992 | Wanlass | |
| 5,222,775 A | | 6/1993 | Kato | |
| 5,411,302 A | | 5/1995 | Shimada | |
| 5,516,164 A | | 5/1996 | Kobayashi | |
| 5,639,130 A | | 6/1997 | Rogers | |
| 6,565,131 B2 | * | 5/2003 | Roos | 292/201 |

FOREIGN PATENT DOCUMENTS

| | | |
|---|---|---|
| EP | 0106725 | 4/1984 |
| EP | 745746 | 12/1996 |
| GB | 528082 | 10/1940 |
| WO | WO 96/28666 | 9/1996 |

* cited by examiner

*Primary Examiner*—Gary Estremsky
(74) *Attorney, Agent, or Firm*—Stetina Brunda Garred & Brucker

(57) ABSTRACT

A latch arrangement for releasably retaining a striker, comprising a latch bolt shaped to retain the striker at a latching position, and to release the striker at an unlatching position of the latch bolt; a locking mechanism moveable between a locking position, at which it retains the latch bolt at its latching position, and an unlocking position, at which it allows the latch bolt to move to its unlatching position; means for linking the locking mechanism to a latch-opening external manual control such as a door handle; drive means coupled to the locking mechanism and/or the latch bolt for powered actuation thereof to latch or unlatch the locking mechanism and/or to drive the latch bolt to its latching position or to its unlatching position; a rotary clutch coupling the drive means to an electrical drive motor; and a clutch release mechanism drivingly coupled to the said external manual control such that operation of the latch-opening external manual control isolates the latch bolt and locking mechanism from the drive means.

14 Claims, 14 Drawing Sheets

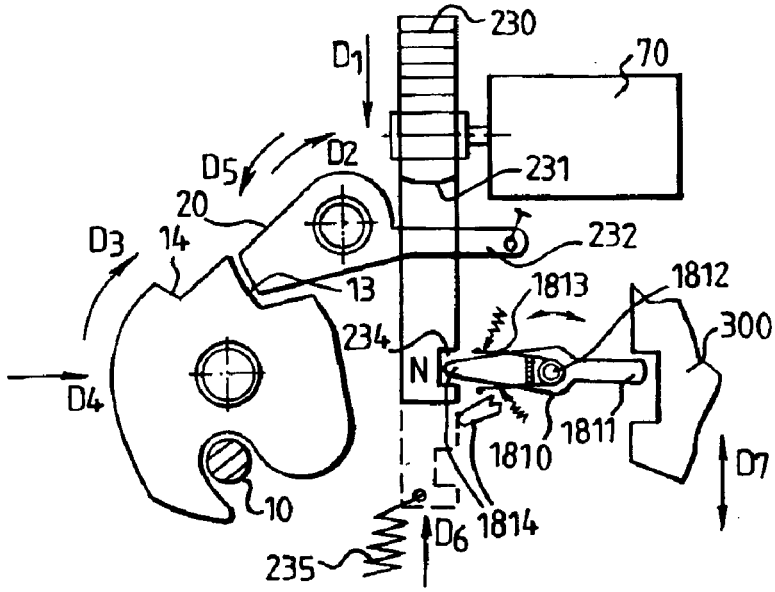
Fig.10A
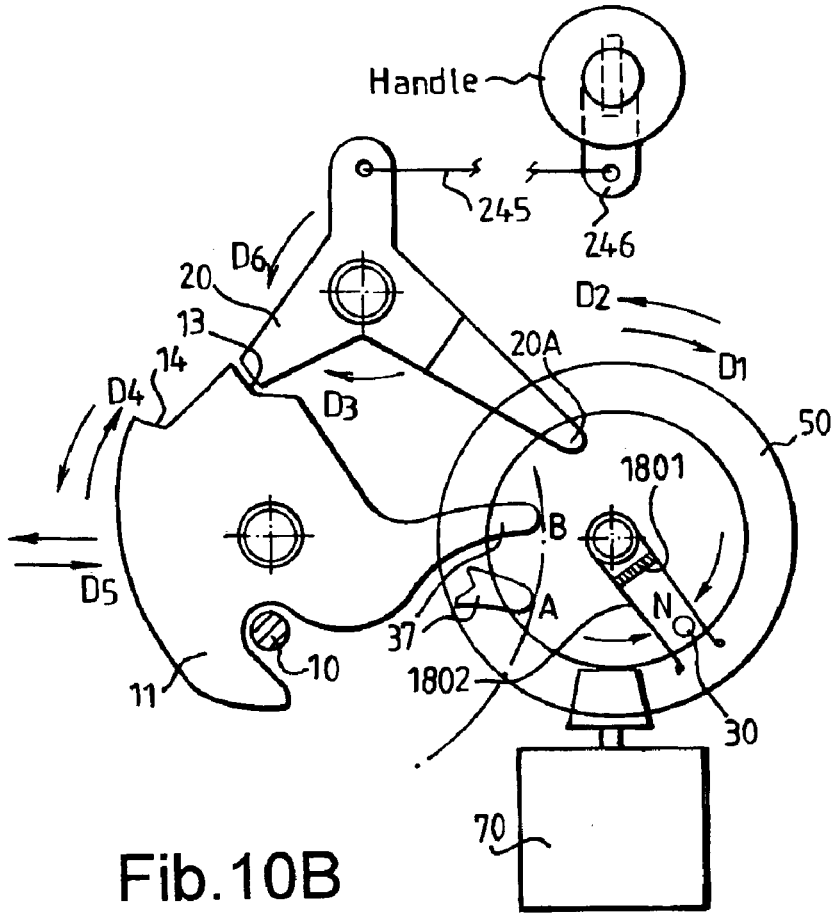
Fib.10B

LATCH ARRANGEMENTS FOR AUTOMOTIVE DOORS OR OTHER CLOSURES

This application is a continuation of Ser. No. 09/372,912, filed Aug. 12, 1999 now U.S. Pat. No. 6,386,599.

This invention relates to latch arrangements for closures such as automotive doors and tailgate locks, and is particularly, although not exclusively, useful with electronic central locking systems for vehicles. The inventions disclosed in this application concern components of the latches, systems incorporating such components, and methods of manufacture of latch arrangements. Generally, the purpose of each invention is to simplify and render more compact such latch arrangements, in order to reduce their cost and to reduce vehicle weight.

Electronic central locking systems are well known, and a typical such system is disclosed for example in GB-A-2167482; an improvement is disclosed in our PCT publication WO97/28338. These systems provide central control of the locking and unlocking of vehicle doors and other closures such as tailgates, bonnets and petrol caps, amongst other vehicle functions such as lights. They interact mechanically with the conventional locking mechanisms which usually comprise, for some doors, an external key mechanism and an internal door locking knob. Interior and exterior door handles are rendered inoperable or neutral by such locking mechanisms.

Vehicle door latches are disclosed for example in our own applications WO97/19242 entitled "Latch and Latch Actuator Arrangements", WO97/19243 entitled "Latch Arrangement suitable for an Automobile Door" and WO97/28337 entitled "Latch Actuator Arrangement". An electric motor incorporated within the latch, and usually controlled by the central locking arrangement, drives a mechanism for unlocking and locking the latch. A problem with door latches manufactured in accordance with other patent publications, such as EP-A-397966 (Roltra-Morese Spa) and GB-A-2221719 (Kiekert GmbH & Co Kommanditgesellschaft) has been size, weight and complexity.

Further, whilst mechanisms for using an electric motor to complete the closure of a partially-closed door are known as such, for example from U.S. Pat. No. 5,423,582 (Kiekert GmbH & Co Kommanditgesellschaft), and systems for using an electric motor to release the latch and allow the door to open are also known, for example from EP-A-625625 (General Motors Corporation) which discloses power-assisted door opening and closing, none of these prior systems has been hitherto capable of integration with electronic central locking. Some of the present inventions disclosed in this application provide integrated electric central locking and electric door opening and/or closing, and even the possibility of using a common electric motor for all these functions. This represents a substantial improvement to the state of the art.

To illustrate the possible saving in the number of latch components required to be assembled in manufacture, it can be seen for example from EP-A-743413 (Rockwell Light Vehicle Systems (UK) Limited) entitled "Vehicle Door Latch Assembly" that a very large number of components is typically required in a vehicle door latch. The present inventions reduce significantly the number of components, by simplifying the mechanical operation of the latch and its interaction with electric motor drive.

It is an important security feature that all electrically-operated drive systems, such as locking and door opening or closing, can be overridden by corresponding manual mechanical drive, as appropriate, in case of electrical malfunction or jamming. Each separate invention is capable of being used in a latch with fill mechanical override.

Double locking or so-called deadlocking or "super locking" mechanisms for vehicle doors are known as such. If the door has been locked by the key mechanism or electronic central locking, then it cannot be unlocked by the interior door knob. It can be unlocked by the interior door knob only if it has previously been locked by the door knob. To achieve this efficiently and simply, an invention provides an automobile door latch having a deadlocking arrangement.

Existing door latches for vehicles generally include components within a housing, and components extending outside the housing which make the arrangement bulky. As shown for example in Kiekert U.S. Pat. No. 5,419,597, the levers which cause the latch to release and the door to open, and which are connected to door handles by cables, generally project from the latch housing. We have discovered that it is possible to simplify the latch arrangement and to accommodate door handle-operated levers inside the latch housing, by providing a common axis of rotation for the latching pawl (sometimes denoted by the general term "locking member"), the pawl release lever connected to the door handle, and preferably also a rotary coupling member for selectively coupling the pawl release lever to the pawl.

Door latches typically comprise housings to which components are permanently riveted, so that the door latch cannot be disassembled non-destructively. An invention overcomes this problem, and also simplifies the process of assembly, by providing a latch assembly whose housing has a retaining means for retaining parallel plates releasably.

In some door latch arrangements incorporating electrically-powered actuation members for locking and unlocking, locking and unlocking is temporarily blocked if one of the door handles is pulled, but is unblocked once the handle is released. It then becomes necessary to repeat the actuation for locking or unlocking. In order to overcome this problem, an invention enables such actuation to be continued fully to completion once the handle has been released, without the need to repeat the actuation.

In order to couple electric motor drive to various appropriate actuation members within the latch assembly, for door opening and/or closing and/or for locking and unlocking or other functions such as child-safety locking, we have discovered that a rotary indexing mechanism is particularly useful, in which there is resilient coupling between formations in the driving actuators and formations on the rotary indexing mechanism. The resilience of this coupling allows the continued rotation of the indexing mechanism past the actuator once actuation has been completed over a phase of rotation of the indexing mechanism, by allowing positional tolerance.

As mentioned above, some of the inventions herein concern electric door opening, i.e. electrically-driven release of the latching mechanism to enable the door to open. An invention provides for the selective coupling of interior or exterior door handles, for example, to the door opening mechanism of the latch arrangement, under the control of a common electric motor. This is particularly advantageous as it provides electric control independently of each door handle, and thereby avoids the need to use a mechanical control for child-safety locking.

Some existing door latch arrangements provide for so-called panic door opening, by which the door can be unlocked by the operation of the interior door handle without the need to lift the interior door knob. The door then remains unlocked to ensure that the door can be opened by the exterior door handle. This prevents inadvertent locking out of the vehicle by the occupant. Usually, the door latch will be unlocked when the vehicle is in motion, but there may be circumstances in which it is locked with the vehicle stationary or even moving. The invention enables panic door opening to be provided in a latch arrangement of compact and simple design.

A particularly important invention is the combination of electric locking and electric door latch release (door opening) using a common electric motor. The invention also provides electrically-powered door closing, using the same electric motor. Preferably also such latch arrangements provide selective electrical control of interior or exterior door handles, for example, for door opening, and preferably they also provide electrically-operable child-safety.

Latch arrangements typically comprise a latch bolt, for engaging a fixed striker in the door frame, and a latching pawl for releasably holding the latch bolt so as to latch the bolt. Electric door opening can then be achieved by actuating the latching pawl. We have discovered a particularly beneficial arrangement for electrical door latch release and door opening, using a linear actuator acting directly on the latch pawl, this arrangement allowing independent door opening by external mechanical means such as the door handle.

An alternative beneficial arrangement for electrical door latch release on manual door opening, uses a rotary actuator acting directly on the latch pawl.

Electrically-powered door closing requires application of the drive to the latch bolt which then pulls on the fixed striker to draw the door to its fully closed position. We have found that a particularly beneficial arrangement is to have a rotary actuator, under electric power, acting on the latch bolt. Preferably, the arrangement also provides door opening, i.e. the same electrical drive, and preferably the same rotary actuator, is used to release the latch pawl to allow the door to open.

As a beneficial alternative to using a rotary actuator, an invention also provides a linear actuator acting directly on the latch bolt, against with optional door opening.

With all these arrangements, there is preferably a full mechanical override of any electrical function, i.e. mechanical actuation is independent.

With door latching arrangements there is a danger of inadvertent door locking when the door is slammed shut. This is particularly disadvantageous in electric central locking arrangements in which the locking of one door is linked to the locking of all doors. Existing anti-slam locking arrangements are generally quite complex, and one purpose of the invention is to provide an anti-slam latching arrangement with all the advantages of compactness and simplicity of the other inventions. This is achieved by appropriately orientating a reciprocating sliding coupling member within the latch arrangement. According to one embodiment of anti-slam latching is achieved differently, by ensuring that an actuator is prevented from moving within the latching arrangement whenever the arrangement is unlatched and the door open. The latching arrangement has a fixed formation which co-operates with the coupling actuator only at its unlocking configuration.

In order that the inventions may be better understood, the preferred embodiments thereof will now be described, by way of example only, with reference to the accompanying drawings, in which common reference numerals are intended to denote identical or equivalent parts throughout:

Figure 8:
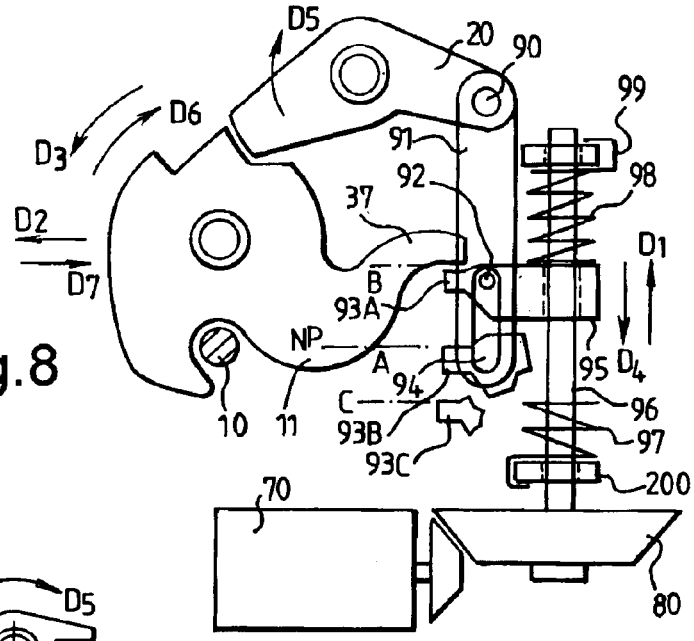
FIG. 8 shows an electrical door opening and closing arrangement as a variant of FIG. 5.
Figure 11:
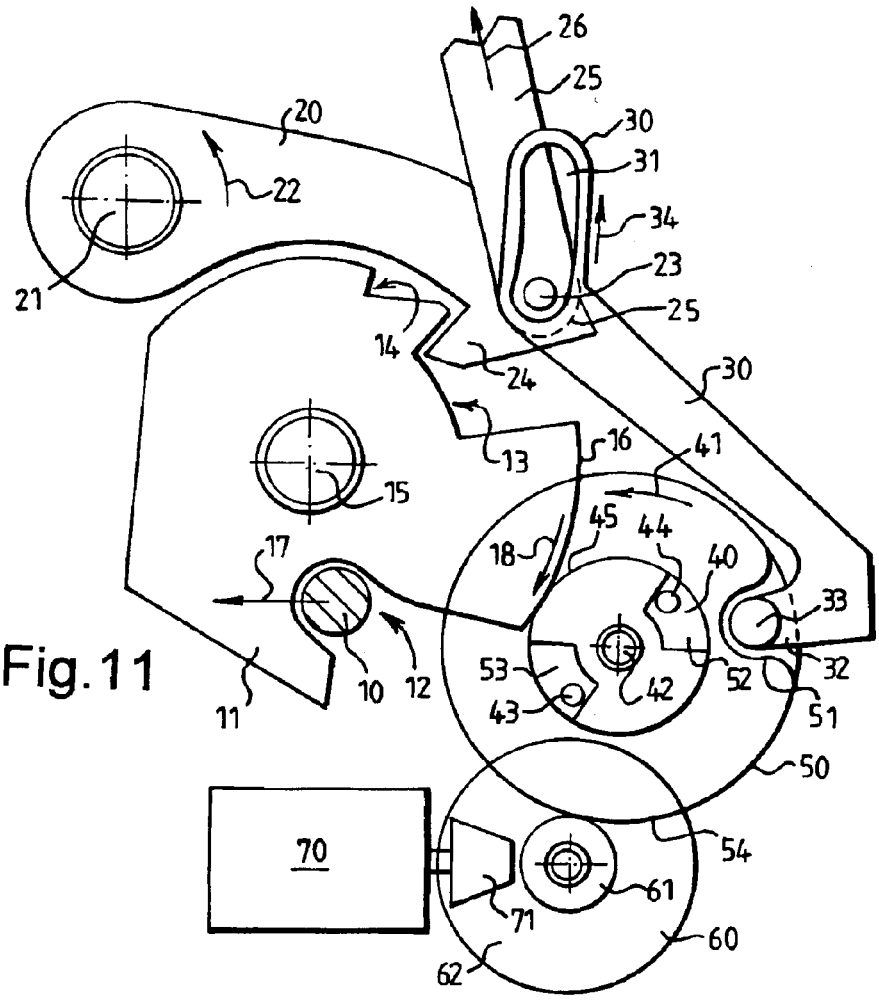
Figure 12:
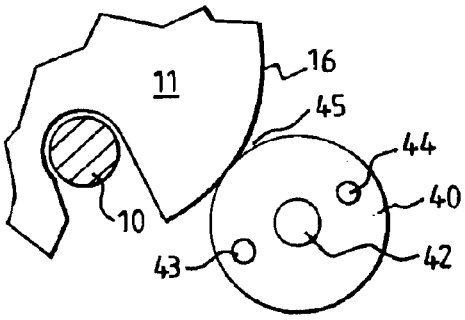
Figure 13:
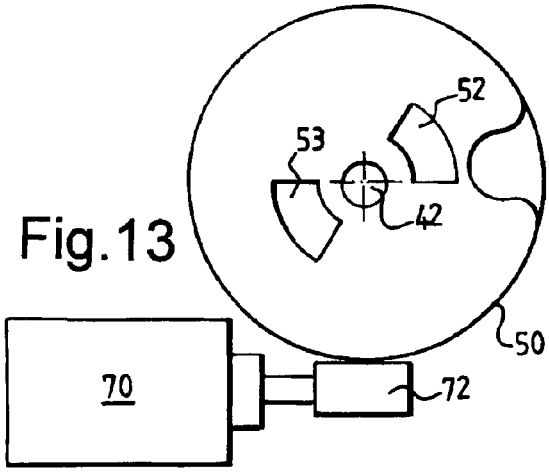
Figure 14:
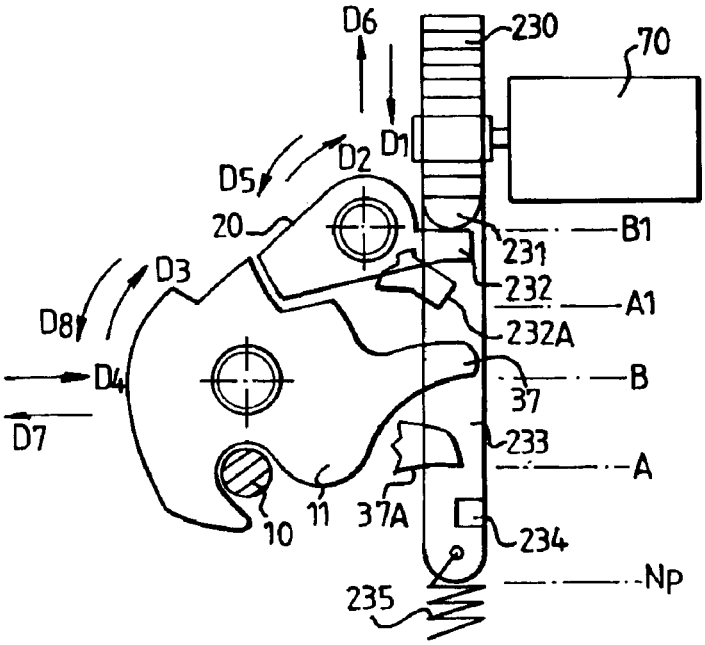
Figure 15:
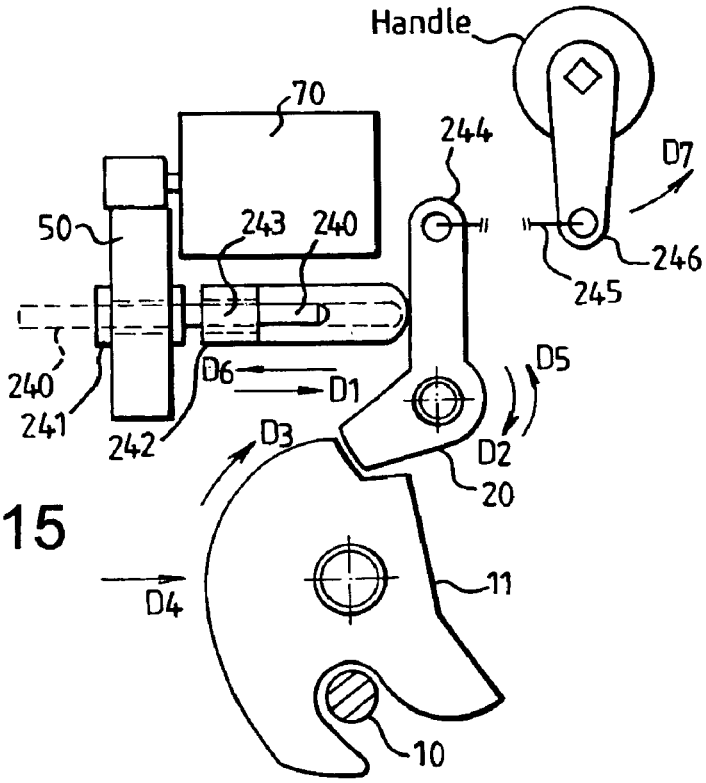
Figure 16:
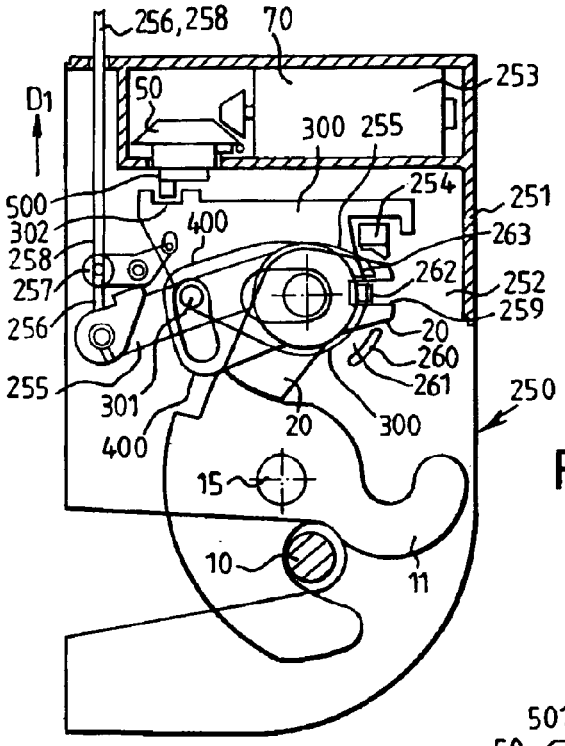
Figure 17:
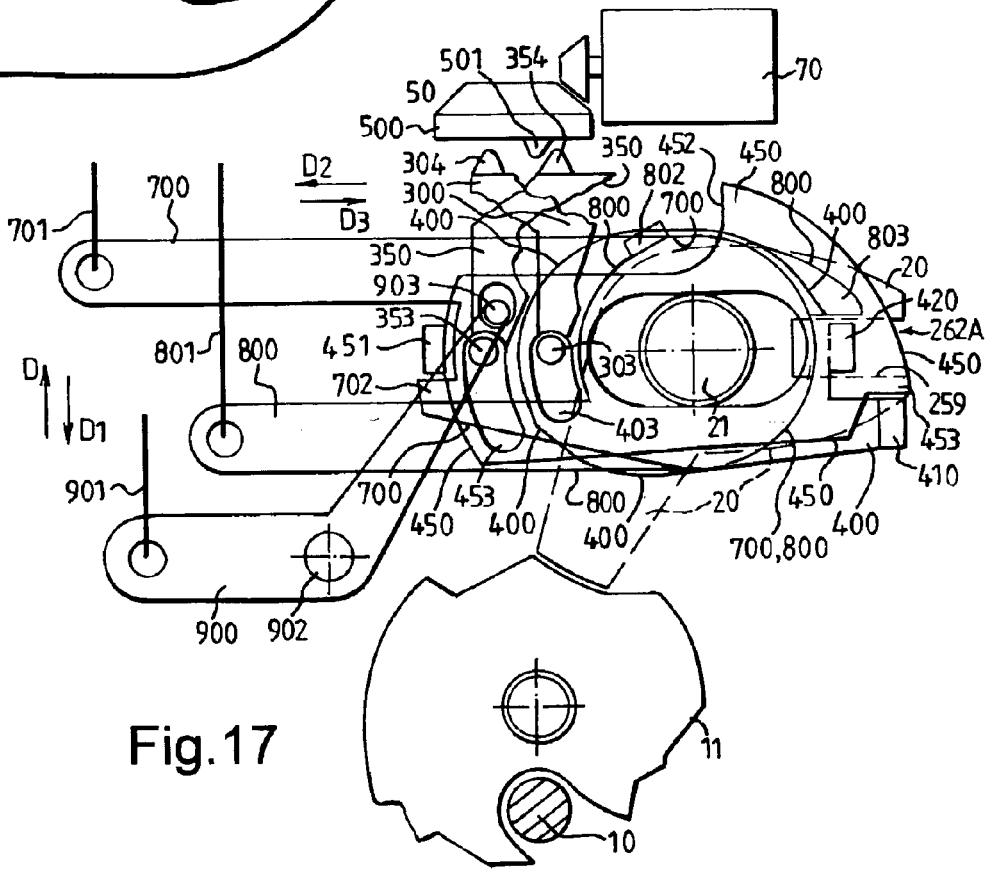
Figure 18:
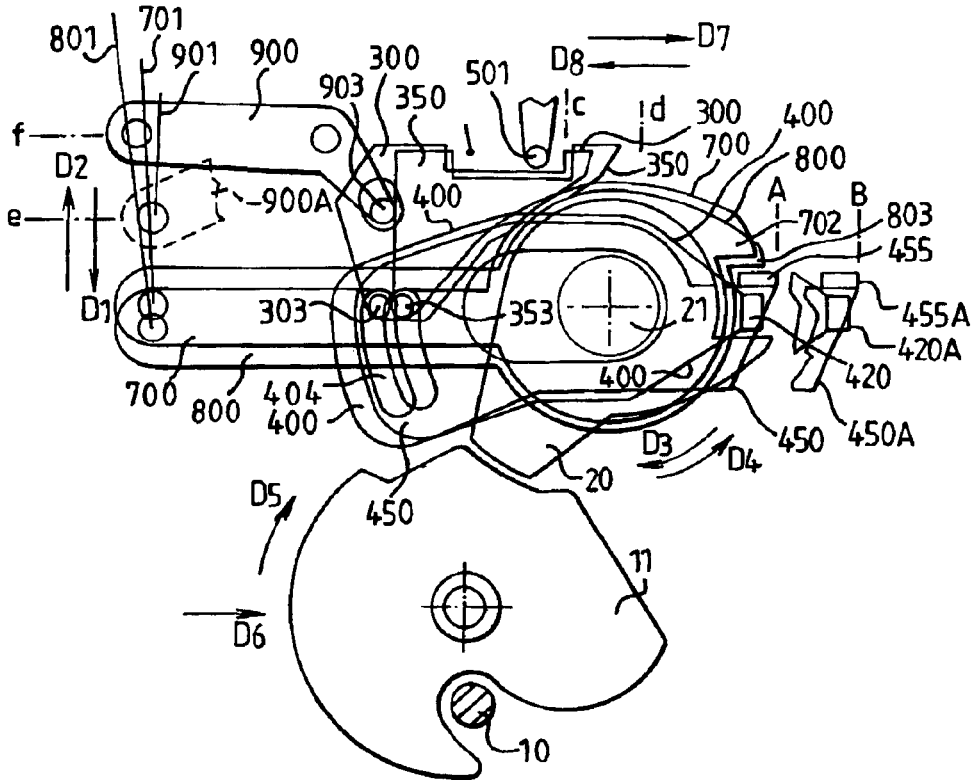
Figure 18A:
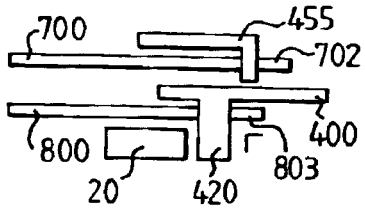
Figure 19:
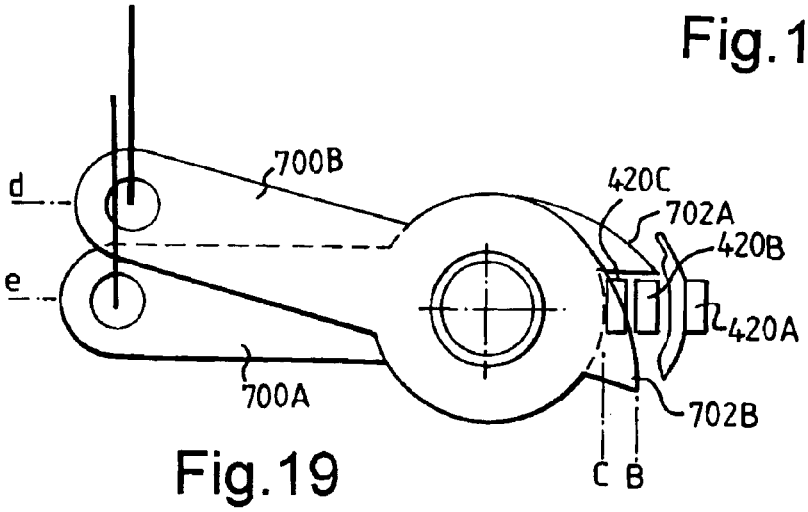
Figure 20:
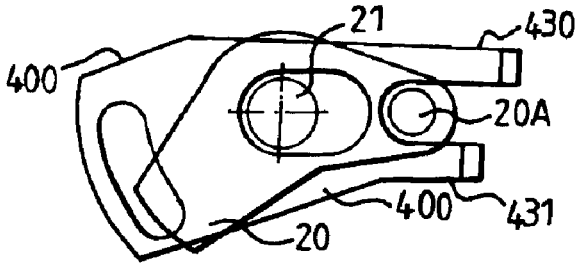
Figure 21:
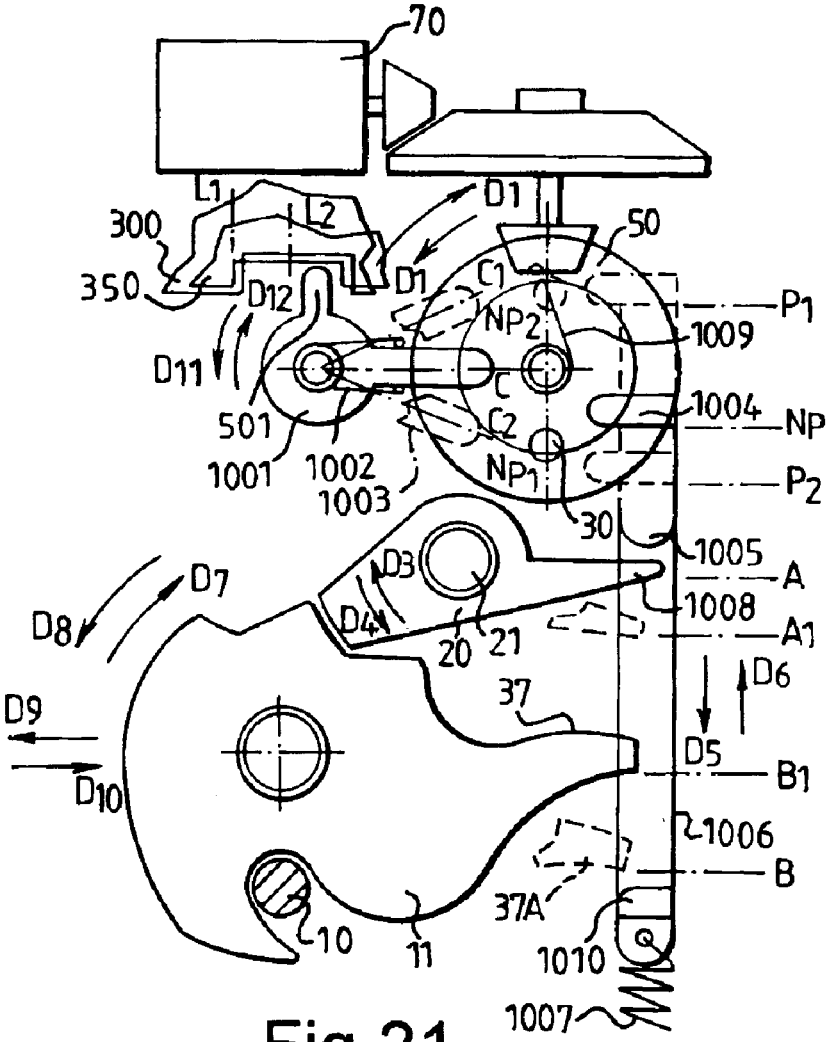
Figure 22:
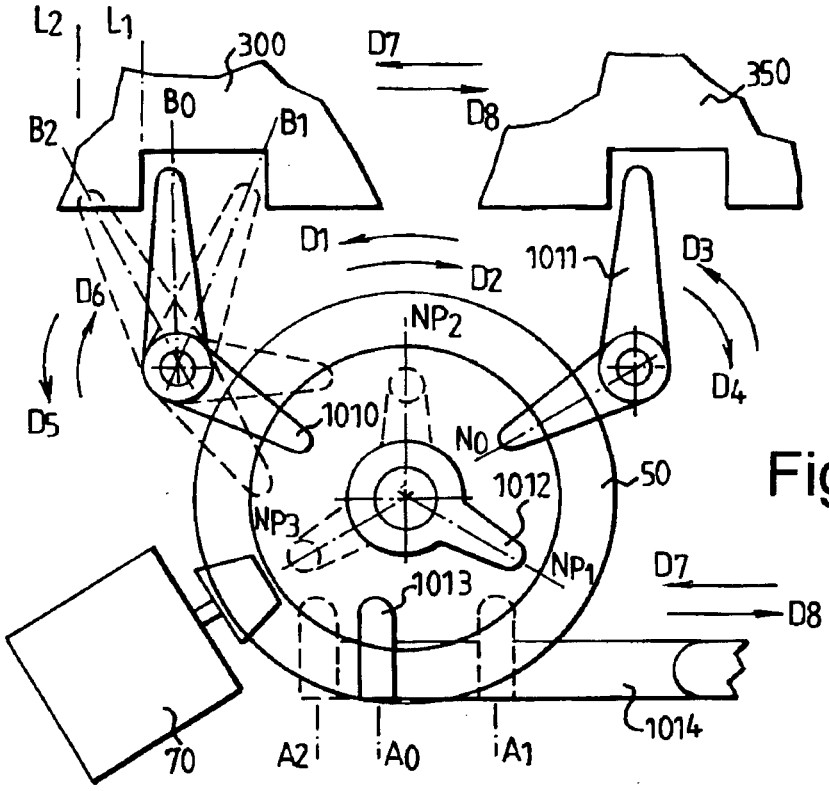
Figure 23:
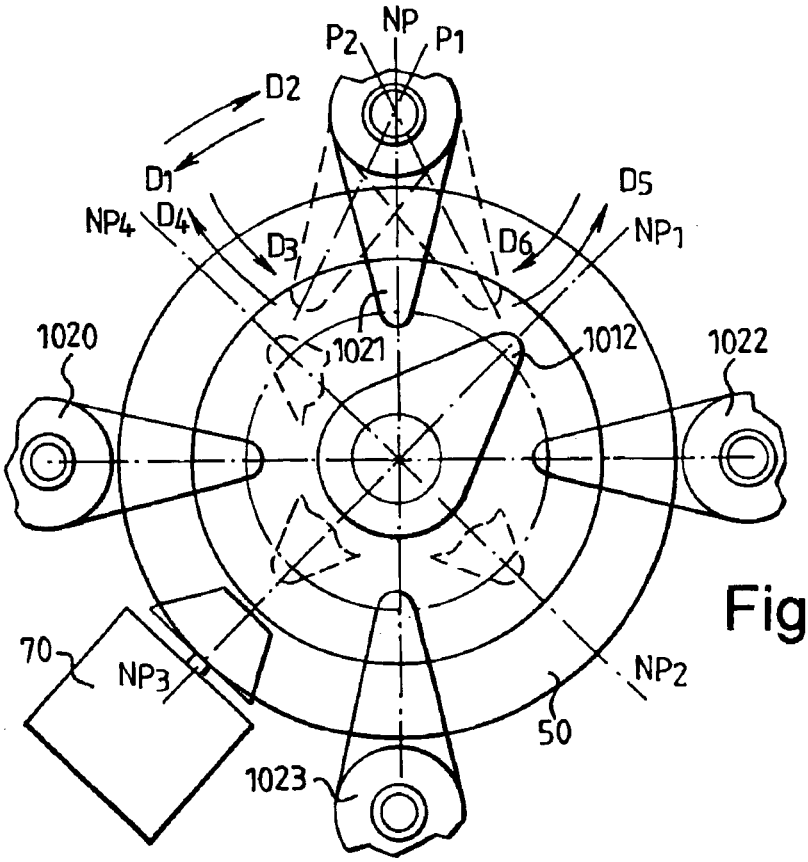
Figure 24:
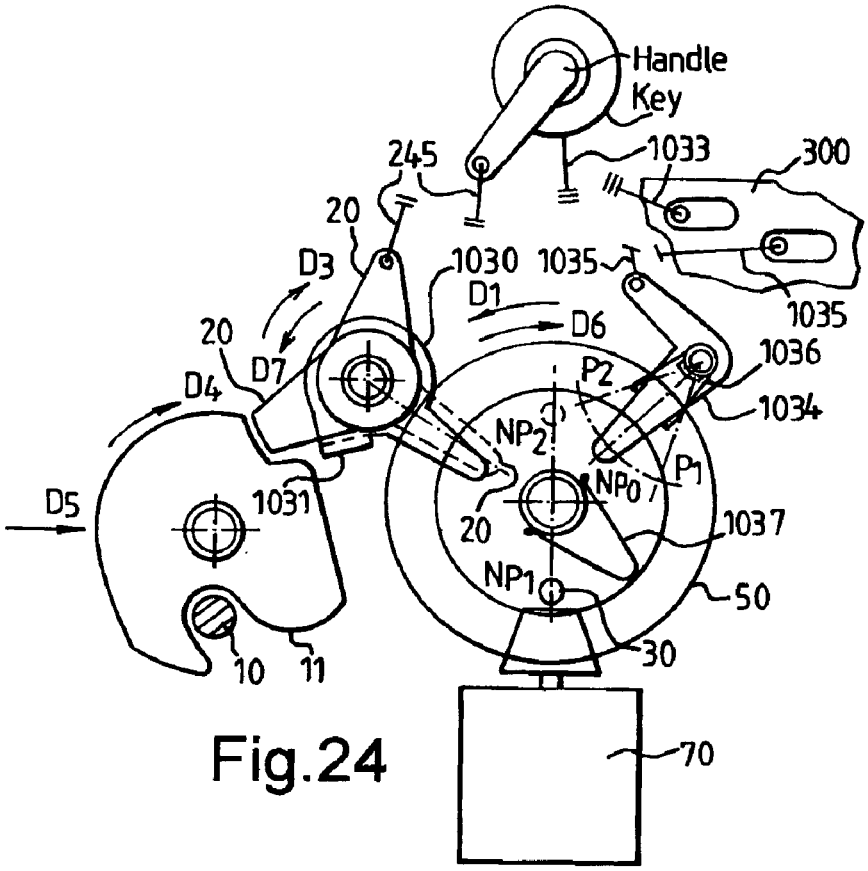
Figure 25:
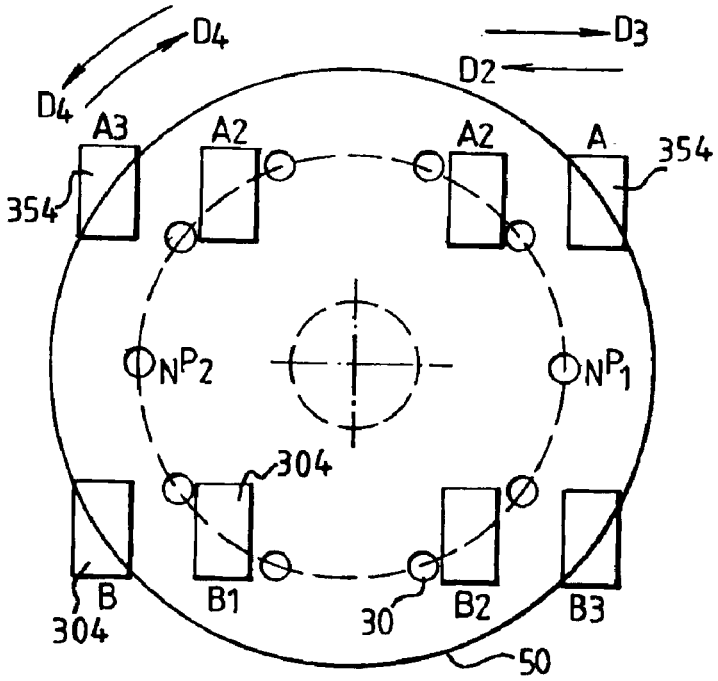
Figure 26:
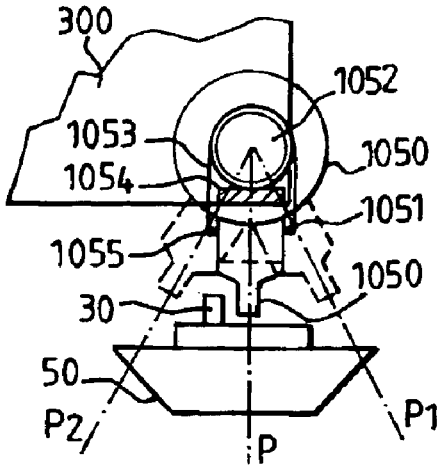
Figure 27:
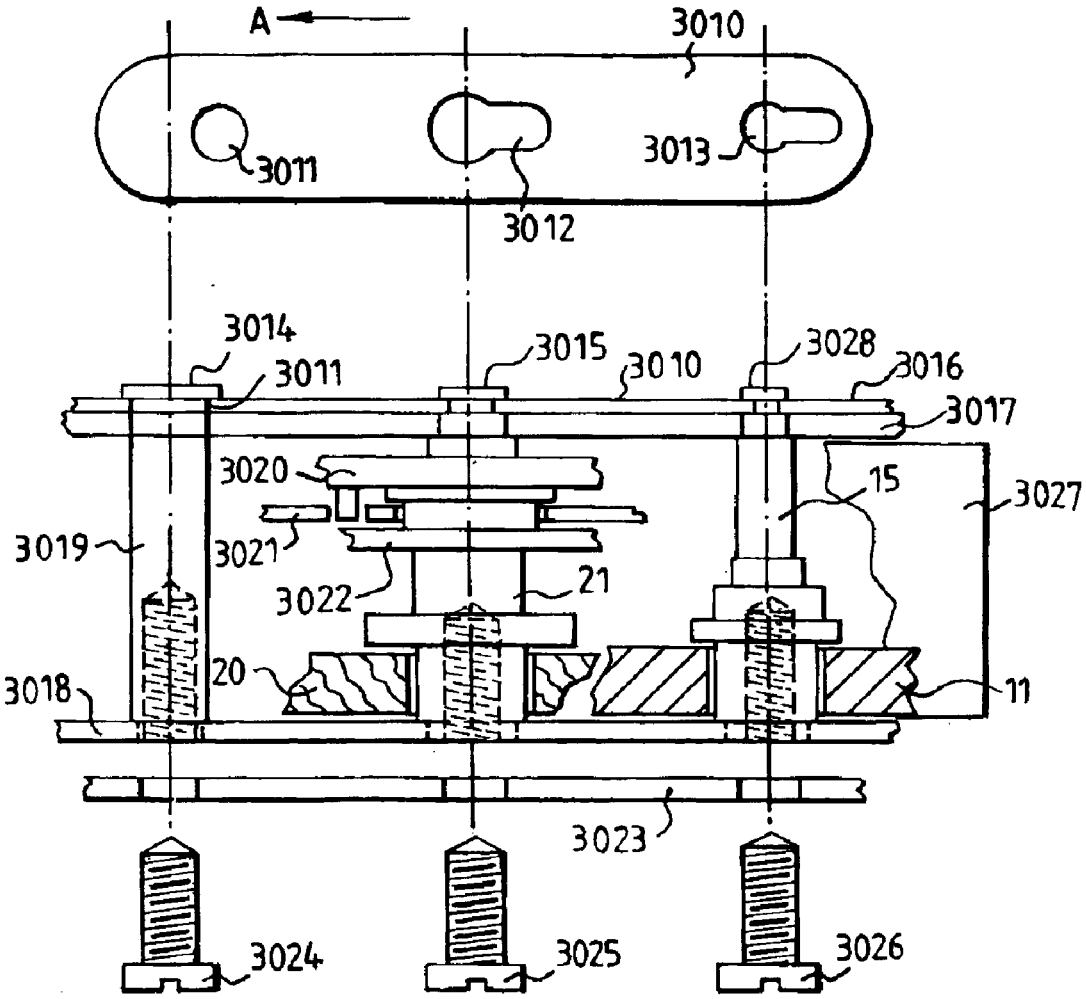

FIG. 10*a* shows a door opening arrangement integrated with electrical locking;

FIG. 10*b* shows an electrical door opening and closing mechanism, using a bi-directional rotary driving and indexing arrangement;

FIG. 11 shows a latch arrangement with a rotary driving and indexing mechanism for electrical door opening and closing, also enabling powered door opening;

FIG. 12 is a partial view of two of the components of FIG. 11;

FIG. 13 is a simplified view of two of the components of FIG. 11, but in which the motor gearing is modified;

FIG. 14 shows an electrical door opening and closing mechanism, as a variant of FIG. 8;

FIG. 15 shows a further door opening arrangement;

FIG. 16 shows a compact latch arrangement within a housing suitable for vehicle doors, with electric locking;

FIG. 17 shows a latch arrangement for the selective electrical locking of a door with two door handle mechanisms and an interior door knob;

FIG. 18 shows a variation of the latch arrangement of FIG. 17;

FIG. 18A is a schematic partial enlarged end view from the right of the arrangement of FIG. 18;

FIG. 19 shows a door handle lever of the type shown in FIGS. 17 and 18 and illustrates how the actuation of the mechanism towards its unlocked, handling-coupling position is continued automatically even after it has been blocked temporarily by the door handle being actuated;

FIG. 20 illustrates an alternative form of rotary coupling member for the arrangements shown in FIGS. 17 and 18;

FIG. 21 shows an integrated electrical door opening and closing, and central locking arrangement, using a common electrical motor;

FIG. 22 shows the use of a rotary indexing and driving mechanism for three separate actuation functions in a latching arrangement;

FIG. 23 shows a variation of the arrangement of FIG. 22, for four independent actuation mechanisms;

FIG. 24 shows the use of a rotary indexing and driving mechanism for the independent actuation of locking and door opening, suitable specially for use with a tailgate or boot latch;

FIG. 25 shows the use of a rotary indexing and driving mechanism for driving, two linear actuators selectively, for example those shown in FIGS. 17 and 18;

FIG. 26 illustrates a possible form of resilient coupling between an actuation member and a rotary drive member, useful for example in the arrangement of FIG. 17;

FIG. 27 shows part of a latch arrangement of the type shown in the other drawings, with a single housing which is disassemblable non-destructively;

MOTOR VEHICLE WITH CENTRAL LOCKING ELECTRICAL DOOR OPENING AND/OR CLOSING

The operation of the latch bolt and pawl in relation to the movement of the door is described below with reference to FIGS. 1 to 27 and also in the published patent specifications referred to above.

Figure 1:
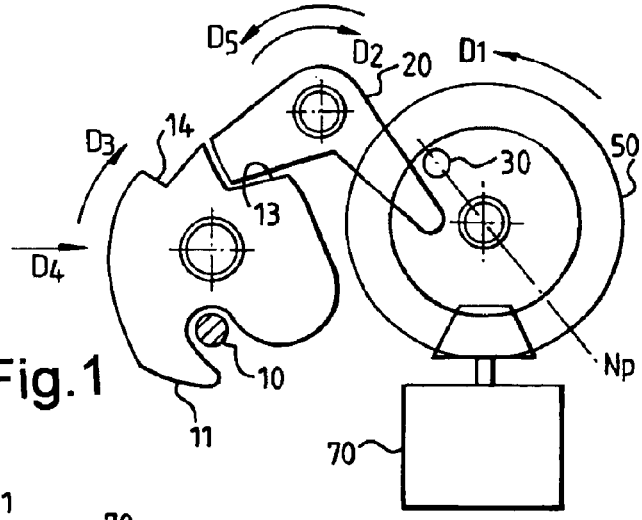
FIG. 1 shows an electric door opening mechanism.

As shown in FIG. 1, a latch bolt 11, closeable around a striker 10, has notches 13 and 14 respectively for full-latch and half-latch detention of the pawl 20. The latch bolt 11 is spring biased clockwise to the open position, and the pawl 20 is spring biased anti-clockwise (D5) to the latching position at which the latch bolt is latched. An electric motor 70 has a rotary output with crown and bevel gearing to a rotary output drive 50 which is arranged to rotate in the direction D1 so that its eccentrically-located projecting pin 30 abuts against the pawl 20 to move it in direction D2 to its unlatching position. Upon continued rotation in direction D1, the pin 30 allows the pawl 20 to spring back in direction D5, to latch the latch bolt once again after the door has been closed.

The pin 30 is returned to its original neutral position Np, as shown in FIG. 1, either by the force of the pawl 20 returning to its latching position, or else under the reverse drive of the electric motor 70. It is then ready, in its neutral position, for a further door-opening actuation.

Obviously alternative output drive couplings are possible, for example screw gears or spur gears. Further, the pin 30 could be replaced with any form of cam arrangements for abutting against a pawl.

In this arrangement, the door is opened, once the pawl has moved to its unlatching position, under the force of the resiliently-deformed door seal. The spring bias of the latch bolt 11 also contributes to the opening of the door.

Figure 2:
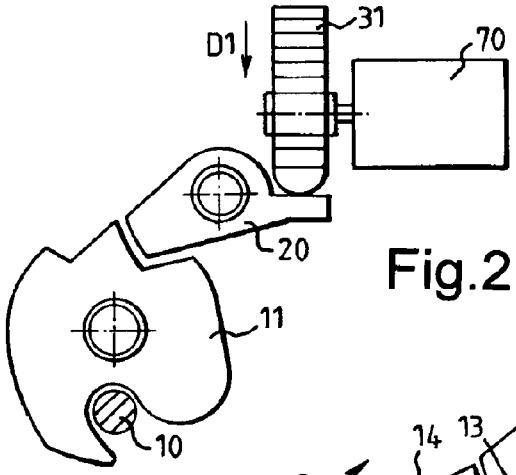
FIG. 2 shows an alternative electrical door opening mechanism.

An alternative form of door opening arrangement is shown in FIG. 2. The electric motor 70 output drive takes the form of a rack and pinion arrangement 31 producing linear drive in the direction D1, with part of the rack abutting against the pawl 20. Once the latch bolt has been electrically sensed to have moved to its fully unlatched position, the electric motor is either switched off, or else powered in the reverse direction, to bring the rack 31 back to its neutral position as shown in FIG. 2. When it is switched off, the rack remains in its door-opening position until the door is shut. Shutting the door causes the pawl to rotate to its latch engaging position, simultaneously driving the rack back to its neutral position. This is assisted by the spring biasing of the pawl 20.

The sensing of the position of the latch bolt also of course applies to the arrangement of FIG. 1, for either switching off or reverse powering of the electric motor.

The arrangements of FIGS. 1 and 2 are suitable for vehicle side doors. Tailgate and boot latch bolts differ from that illustrated, in that they normally have only one notch 13, for fully latching the bolt. Again, various alternative gearing arrangements would of course be possible.

Figure 3:
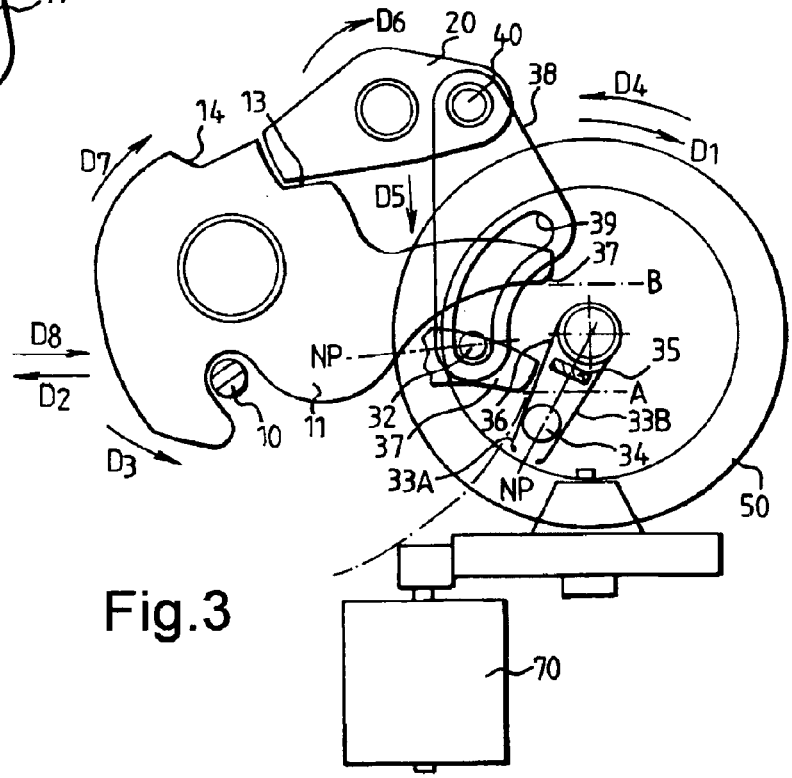
FIG. 3 shows an electrical door opening and closing mechanism.

The latch arrangement shown in FIG. 3 provides for powered door closing as well as electric door opening. Thus it is an opening and closing mechanism, powered by the same electric motor 70. The electric motor drives a rotary indexing and driving member 50 selectively in either direction, D1 or D4. Its neutral position Np, shown in FIG. 3, corresponds to the position at which its pin 34 is free of the door latch 11. The indexing and driving member 50 is rotationally biased towards its neutral position by a torsion spring 36 mounted co-axially with the member 50, and constrained by a bar 35 fixed to the latch housing. The torsion spring 36 has two limbs 33*a* and 33*b* which engage opposite side surfaces of the projecting pin 34. Thus as the member 50 is driven clockwise in direction D1, pin 34 drives limb 33*a* of the spring which then causes the member 50 to return in the opposite direction to the neutral position. Correspondingly, anti-clockwise movement D4 causes pin 34 to displace limb 33*b* of the spring, which again returns the member 50.

In this example, the unlatching or release of the pawl 20 is achieved indirectly through an actuation plate 38 pivotally connected at 40 to the pawl 20, and coupled to the rotary indexing and driving mechanism 50 by means of an arcuate slot 39 and a projecting pin 32 of the member 50. The arcuate slot 39 of the actuation plate 38 is concentric with the rotary member 50, and its function is to allow relative rotation of the rotary member 50 for approximately 70° in the clockwise direction D1, for door closing, without interference.

An extension arm 37 of the latch bolt 11 projects over the rotary indexing and driving member 50 for selective engagement with the pin 34. To close the door, the pin 34 is driven clockwise in direction D1 to the position A which the latch bolt 11 will have reached as a result of partial closure of the door manually. Completion of door closing is achieved by pin 34 abutting against extension 37 and driving it in the direction D3 to its fully latched position B. Once the latch bolt is electrically sensed to be fully latched, the motor is switched off and the rotary member 50 is returned by the spring 36 to its neutral position Np.

To open the door electrically, the motor drives the pin 34 anti-clockwise in direction D4, causing the pin 32 immediately to pull the end of the slot 39, thus to pull the pawl 20 in the direction D5 to unlatch it in direction D6. The latch bolt then springs open in the direction D7 as the door moves away from the frame in direction D8. Once the latch bolt has electrically been sensed to have reached its fully unlatched position, the motor is switched off, and rotary member 50 springs back to its neutral position Np.

The electrical position sensors are placed suitably in the latch so that, for example, when the pawl 20 is actuated to its unlatching position, it is prevented from falling into its half-latched position in notch 14.

This arrangement is capable of being accommodated in a single housing which is compact and simple to produce, improving on sound proofing and reducing manufacturing costs.

Figure 4:
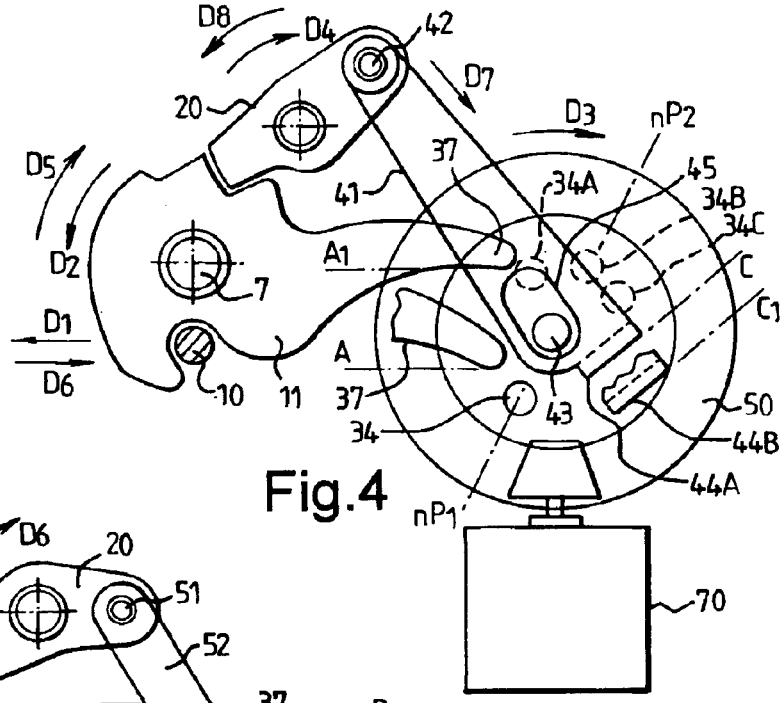
FIG. 4 shows an electrical door opening and closing mechanism.

The latch arrangement of FIG. 4 is a variant of that of FIG. 3 for door opening and closing. In this example, the actuator plate 41, which replaces plate 38, is arrangement to slide over the pivot axis 43 of the rotary indexing and driving member 50; it has a slot 45 which guides it over the pivot 43. The actuation plate 41 has an end flange 44A depending downwardly for abutting engagement with the pin 34 of the rotary member 50. The actuator plate 41 is capable of sliding between positions C and C1, corresponding to the latched and unlatched positions respectively of the pawl 20.

Door closing is caused by rotating the pin 34 clockwise in direction D3 to abut against the latch bolt extension 37 at A and drive it to position A1. After a slight overtravel beyond point A1, the cam pin 34 becomes free from the latch bolt whilst rotating in the direction D3 towards a second neutral position Np2. Thus the first neutral position Np1 is located just before the cam pin 34 engages the latch bolt extension 37. The second neutral position Np2 is located at a point just past A1 but before it can engage the flange 44A. Once freed from the latch bolt, the cam pin 34 stops at its second neutral position Np2 by a resiliently deformable means such as a spring (not shown), after the motor has been switched off under the control of a suitable electrical position sensor (not shown). The motor may also be stopped at the second neutral position by means of a controlled powering of the motor in the reverse direction.

To open the door electrically the motor is powered to drive the cam pin from its neutral position 34B in direction D3 to the point 34C at which it abuts the actuator plate 41 to the point C1 at which the flange reaches the position 44B in direction D7. This causes the pawl to rotate in direction D4 to its fully unlatched position which allows the latch bolt to rotate in direction D5 whilst simultaneously moving away from the striker in direction D6. The cam pin 34 continues in the same direction to its first neutral point Np1.

At either neutral position, the latch bolt and pawl are completely free to be actuated manually, in a conventional manner, between their latched and unlatched positions. Thus conventional mechanical operation is interrupted only during electrical door opening and closing. This provides complete mechanical override as a safety measure against electrical dysfunction.

In contrast to the arrangement of FIG. 3, the rotary indexing and driving member 50 rotates uni-directionally, although its motion may be braked or partially reversed by reversed electrical drive.

The arrangement of FIG. 4 has the advantages of compactness and sound proofing associated with the arrangement of FIG. 3.

Figure 5:
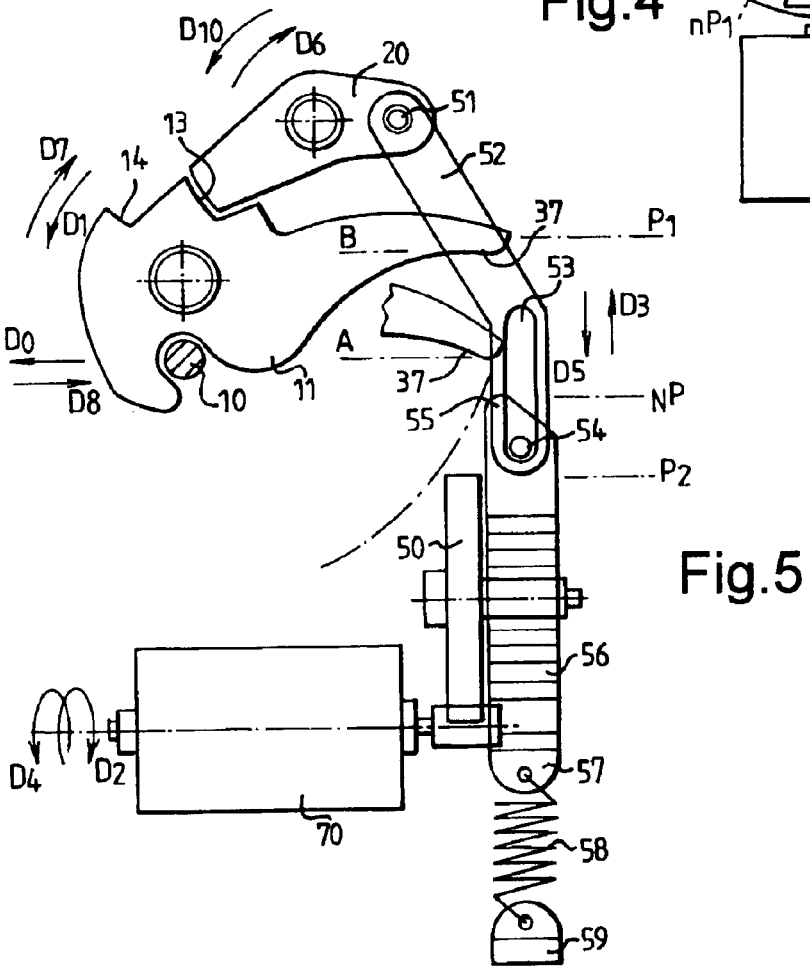
FIG. 5 shows a further electrical door opening and closing mechanism.

A variant is shown in FIG. 5, providing electrical door opening and closing using the same electrical drive motor 70. In this example, the rotary output drive at 50 is converted to linear motion by a rack and pinion gear. The rack 56 is formed integrally with a shuttle which has an end abutment surface 55 for engaging the latch bolt extension 37. At the other end, the rack is connected at 57 to a coil spring 58 mounted on the frame 59 of the latch housing, for compression and tension. The spring serves to return the shuttle to a neutral position NP and also to absorb shock and reduce noise.

The shuttle 56 is connected drivingly to an actuator plate 52 by a pin 53 riding in a slot 53, such that the shuttle is capable of driving the latch bolt for door closing without interference. The actuator plate 52 is pivotally connected at 51 to the pawl 20.

As with the arrangements of FIGS. 3 and 4, the electric drive mechanism is isolated from the conventional mechanical latch operation, by which a door handle operates the pawl, when it is at its neutral position Np.

Thus to close the door the shuttle 56 is driven from its neutral position to its extreme position P1 in direction D3, after which the electric motor is switched off and it returns to its neutral position. Electrical door opening is achieved by driving the shuttle in the opposite direction D5, from the neutral position to the second extreme position P2, which pulls the actuation plate 52 and releases the pawl.

This arrangement uses a potentially smaller drive motor, due to the greater gearing ratio.

Figure 6:
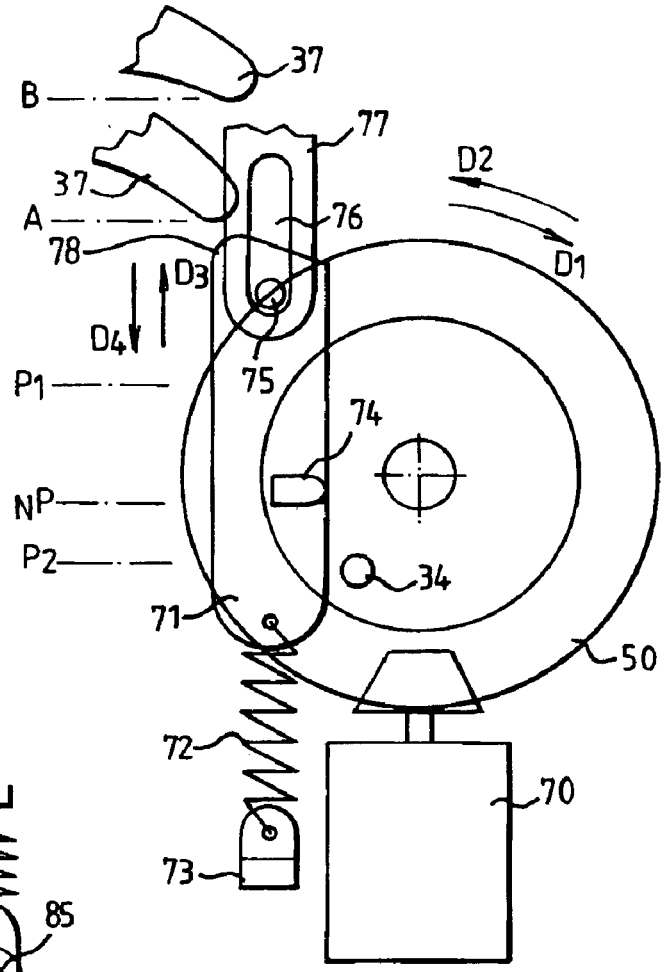
FIG. 6 shows a variant of the electrical door opening and closing mechanism of FIG. 5.

A further modification of the door opening and closing mechanism is shown in FIG. 6. Instead of the rack and pinion arrangement, a linear shuttle 71 is driven in either linear direction by the cam pin 34 of the rotary indexing and driving member 50, in direction D1 or D2 as the case maybe. The cam pin 34 rides against a cam 74 fixed to the shuttle 71, so that drive is effected over a limited angular range or phase, for example about 40°, of rotation of the rotary member 50. Once again, the shuttle 71 is biased towards its neutral position by a tension-compression spring 72 mounted to a frame 73. The shuttle has an end formation 78 which drivingly abuts against the latch bolt extension 37 to move it from position A to position B. For electrical door opening, an actuator plate 77 corresponding to plate 52 is provided to link the shuttle 71 with the pawl 20. As with the arrangement of FIG. 5, a pin 75 on the shuttle slides within a groove 76 of the actuator plate 77.

The arrangement of FIG. 6 has the additional advantage of adaptability, and it provides for an easier movement of the drive gear to its neutral position in the event that electrical actuation is prematurely interrupted.

Figure 7:
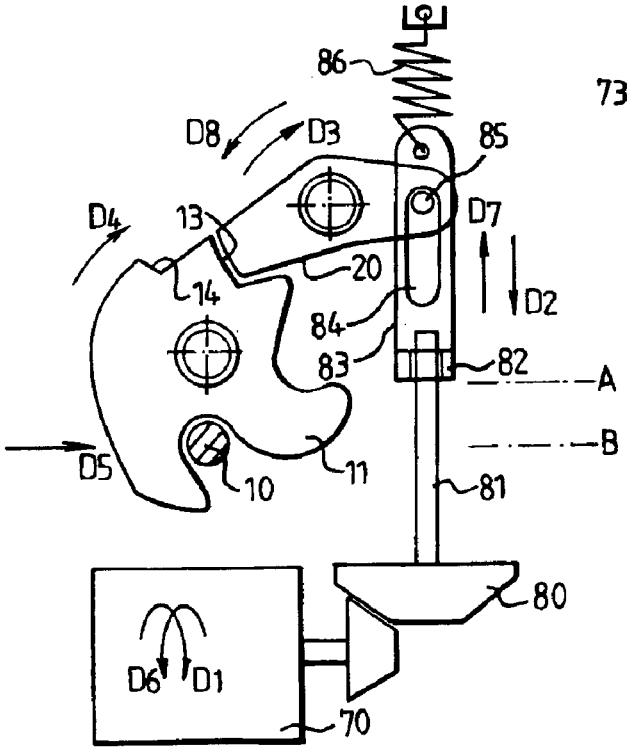
FIG. 7 shows an electrical door opening mechanism, as a variant of FIG. 2.

An alternative arrangement for electrical door opening is shown in FIG. 7. In this example, the shuttle 83, which is again constrained to move linearly, is driven from the electric motor 70 by means of leadscrew gearing taking the form of screw 81 and internally-threaded nut 82. The leadscrew 81 is driven by bevel gearing 80 from the rotary output drive. Once again, the shuttle is spring biased to its neutral position by a tension-compression spring 86. The slot 84 which couples to the pin 85 of the pawl 20 gives sufficient freedom to allow for independent mechanical door opening, as before. In this example, there is no provision for door closing, although of course this arrangement could be incorporated in the door closing arrangements of FIGS. 4 and 5 for example. The arrangement is simplified, and provides for just one neutral position A and one actuated position B of the shuttle 83.

This arrangement has the further advantage of complete independence of the mechanical door opening and closing from the electrical arrangement, at all stages of electrical door opening and closing from the electrical arrangement, at all stages of electrical door opening. It also has the advantages of enabling use with a relatively small motor, due to the high gearing ration, and is extremely adaptable and simple. As before, the compression-tension spring provides an anti-backlash arrangement which reduces noise by absorbing the inertia of the mechanism after the motor has been switched off; this also prolongs the life of the drive mechanism.

A further variation of the door opening and closing mechanism is shown in FIG. 8. The shuttle 95 in this example is driven linearly by a leadscrew 96 between two spaced tension springs 97 and 98 which are mounted on the leadscrew 96 between fixed brackets 99 and 200. The leadscrew is driven by a bevel gear 80 powered by the motor 70. The actuator plate 91 is again coupled to the shuttle 95 by a pin 92 sliding in a slot 94, and the shuttle 95 has an abutment surface at its end 93A which moves between a neutral position 93B, position A, a lower position 93C, position C, at which the pawl is unlatched, and an upper extreme position 93A, position B, at which the latch bolt is completely closed.

Preferably, the nut 95, formed integrally with the shuttle, and the screw 96, have their meshing teeth cut at 45° in relation to the axis of rotation of the leadscrew 96, so that the shuttle can drive the leadcrew and vice-versa. The means for constraining the nut 95 to move linearly may take any suitable form, such as grooves and rails (not shown) fixed to, or integral with, the latch housing (not shown).

The springs 97, 98 may be replaced by a single spring capable of use as a compression or tension spring coupled to the nut 95. It may also be a torsion spring coupled to the drive gear.

As with previous arrangements, electrical position sensing is employed to control the powering of the electric motor. A current sensor may be incorporated with the control electronics as an indicator that the latch bolt, for example has reached its latching position, since only overtravel beyond that point raises the current. Against, polarity of the electrical drive may temporarily be reversed, to counteract the inertia of the moving components.

This arrangement has advantages corresponding to the advantages of the arrangements of FIGS. 6 and 7.

With any of the arrangements of FIGS. 1 to 8, a clutch mechanism may be provided in the rotary output drive of the electric motor 70. A conventional centrifugal clutch is preferred. This would eliminate any inductive current generated in the motor when it is driven by the mechanical components. It also helps to reduce the load on the return springs which are used for bringing the mechanism back to its neutral position after motorized actuation.

Figure 9:
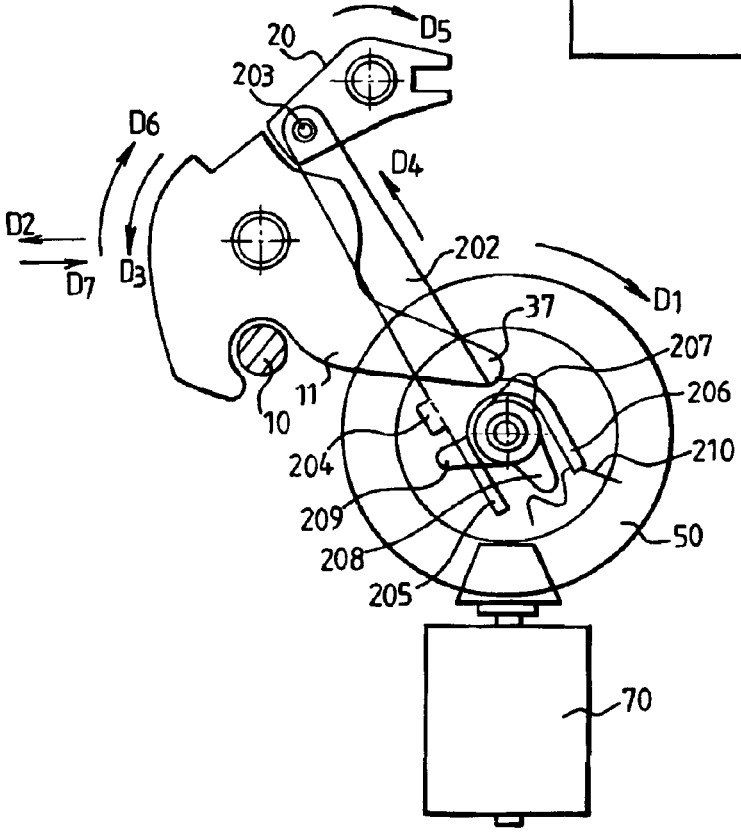
FIG. 9 shows a further electrical door opening and closing mechanism.

A further modification of the previously-described electrical door opening and closing latch arrangements is shown in FIG. 9. In this example, the actuator plate 202 is connected pivotally at 203 to the pawl 20 near to the point of engagement with the latch bolt 11. It therefore operates in the reverse direction, as there is no lever action. This actuator plate 202 is constrained to rotate about the pivot axis of the rotary indexing and driving mechanism 50, or to move linearly in the actuation direction D4, by virtue of an end fork with limbs 205 and 206 on either side of the pivot axis.

In this example, the cam pin 34 is replaced by an arrangement of radial cams all integral with the rotary mechanism 50 and arranged in two separate planes normal to the pivot axis. In a first plane, radial cam 207 is arranged selectively to abut and drive the latch bolt extension 37. In a separate plane, radial cams 209 and 208 of the actuation plate 202 of the door opening, and a W-shaped leaf spring 210 fixed to the latch housing. The W-shaped spring 210 is a shock-absorber for the cam 208 as it rides up either limb, and locates it centrally. The spring 210 prevents backlash as well as locating the arrangement in its neutral position as shown.

To close the door, the rotary member 50 is driven clockwise in direction D1 to drive cam 207 against the latch bolt extension 37, as previously described. To open the door electrically, the rotary member 50 is also driven in direction D1 from its neutral position, to engage the lug 204 to drive the actuator plate 202 in direction D4 to unlatch the pawl.

Should electrical actuation be interrupted for whatever reason, the drive gear is moved back to its neutral position by means of a sliding spring (not shown) coupled to the drive gear. This guarantees full mechanical override, in the case of electrical malfuction.

Figure 10:
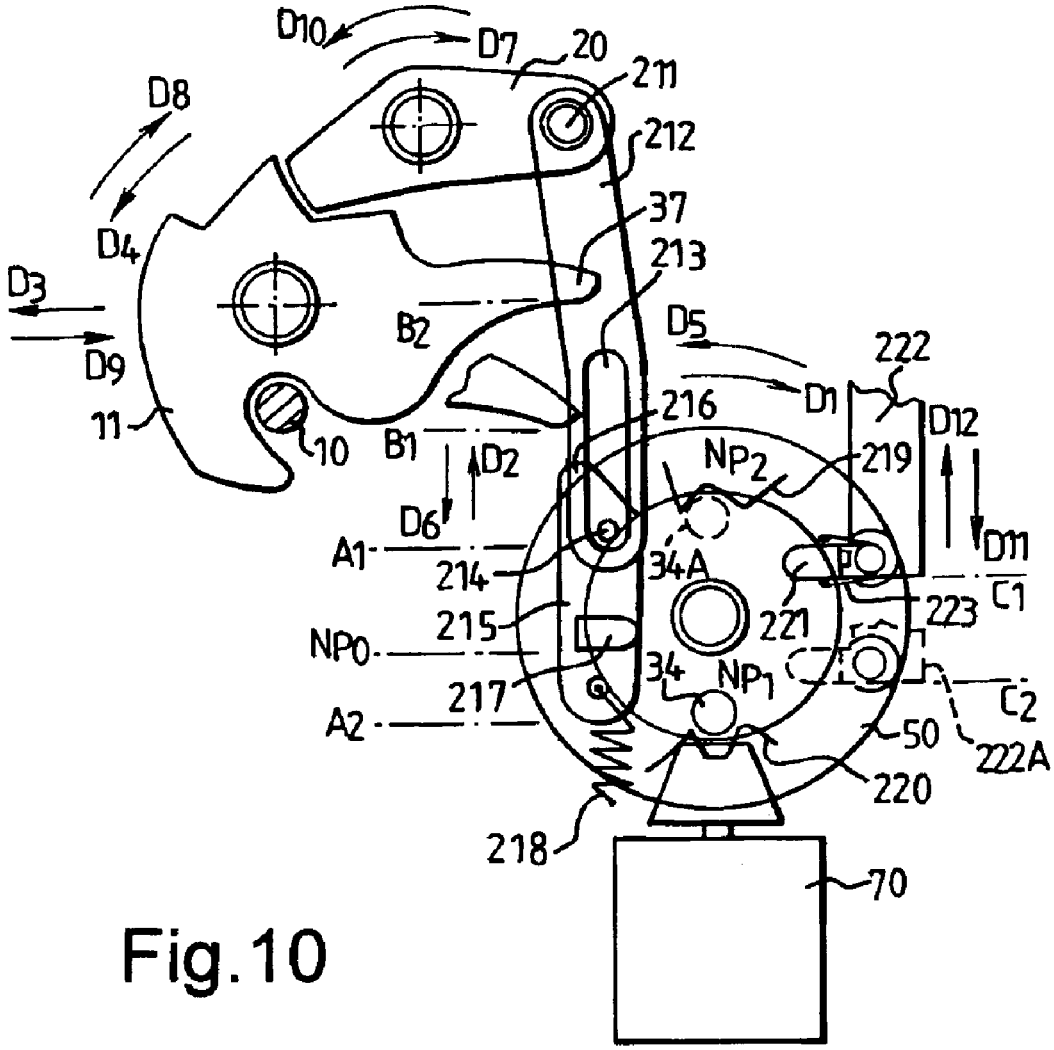
FIG. 10 shows a further electrical door opening and closing mechanism, using a rotary indexing and driving mechanism.

The latch arrangement of FIG. 10 importantly illustrates the use of one electric motor 70, and one rotary indexing and driving mechanism 50, to control independently the door opening and closing mechanism on the one hand, and electric locking, on the other hand. The door opening and closing mechanism involves a shuttle 215 constrained to move linearly, and coupled to a tension-compression spring 218, as previously described in relation to FIG. 6. The rotary member 50 has a single cam pin 34 which is rotatable in either direction D1, D5 between two neutral positions Np1 and Np2, at which it is retained respectively by W-shaped fixed springs 220 and 219. An actuation member 222 is constrained to move linearly in either direction D11, D12 between positions C1 and C2, and it has the toggle lever 221 at its end for engagement with the cam pin 34. The toggle lever 221 may be of the type illustrated and described below with reference to FIG. 26. It is mounted pivotally at the end of the actuation member 222 and biased by a torsion spring 223 to its neutral position normal to the length of the actuation member. This arrangement enables the cam pin 34 to abut drivingly against the toggle 221 to drive the actuation member 222 in direction D11, but then to release it as it is resiliently deformed against the spring torsion, to enable the cam pin 34 to continue its rotary movement. In this example, it is capable of being driven in either direction by the cam pin 34.

As with the W-shaped spring 210 of FIG. 9, the springs 219, 220 have the function of absorbing rotary impact, as the pin rides up against the external limb of the spring from either direction. The cam pin then moves on to settle between the two outer limbs of the pin in the central recess. This prevents accidental overrunning.

Electrical door locking and unlocking, using the actuation member 222, is described below in greater detail with reference to FIGS. 16, 18 , 21–27. Briefly, it interacts with a key mechanism and selectively unlocks or locks the pawl 20 to prevent or allow actuation of door handles or the like being transmitted to the pawl.

A variation of the door opening mechanism of FIG. 2, which also provides for electric locking and unlocking under the control of the same electric motor 70, is shown in FIG. 10A. In this example, a rack and pinion arrangement integral with a linear shuttle drives the pawl 20 by means of an abutment surface 231. The pawl 20 has an extension lever 232 which is driven either by the abutment surface 231, or else by a cable or other link to the latch locking mechanism (not shown). A tension-compression spring 235 again biases the shuttle towards a neutral position N.

For electric locking, the notch 234 in the shuttle selectively engages with the end 1814 of a lever on 1810 pivoted at its centre 1812, and spring biased by a torsion spring 1813 on the pivot axis 1812 towards the neutral position as shown. The opposite limb 1811 engages in a notch of an actuation member 300 capable of moving in either direction D7; for locking and unlocking the latch.

FIG. 10B shows a further arrangement for door opening and closing, which in analogous to the arrangement described below with reference to FIG. 24. The rotary member 50 acts directly on the pawl 20, which has an extension arm 20A, and on the latch bolt extension 37. The cam pin 30 is biased by spring 1802, located around fixed lock 1801, to its neutral position N.

Door closing is effected by driving the cam pin 30 against the extension 37 at the position A towards B; it is then impelled back to its neutral position N by the spring. Driving the motor in the reverse direction, the cam pin 30 moves in direction D2 to abut against the pawl 20A to release the latch bolt. Again, the cam pin 30 can be returned to its neutral position, either electrically or by the return spring.

The pawl 20 can alternatively be released manually by externally operable means, such as the handle through a lever 246 and cable 245.

In this example, the distal end 20A of the pawl 20 is elevated by bending so that it can override the latch bolt extension 37.

This particular arrangement enables a reduction in the drive torque and renders it more adaptable.

Door Opening and/or Closing Under Electric Power The arrangement of FIGS. 11–13 provides electric door opening by which the pawl is first released and then the latch bolt is driven under electric power to ensure that it opens fully. The arrangement also provides for powered door closing, as with arrangements described above.

With reference first to FIGS. 11 to 13 of the drawings, a vehicle door closure arrangement comprises a striker 10 connected to the door frame of a vehicle, and a latch bolt 11 forming part of a latch arrangement supported on the edge of the vehicle door. Whilst the shape of the latch bolt 11 in FIG. 11 is special to the present invention, its general function is conventional and need not be described in detail here. The latch bolt 11 is mounted pivotally at 15 for rotary motion as shown by arrow 18, driven by the relative motion 17 of the striker 10 in a U-shaped notch 12 formed in the latch bolt 11. The latch bolt 11 has two further notches 13, 14 formed in its periphery, for engagement with a locking pawl 20. Notch 13 is for locking the latch bolt at a latching rotary position, which retains the striker 10 and maintains closed the vehicle door. The door is capable of being opened, towards the right in FIG. 1, by releasing the pawl 20 from its locking position in notch 13, allowing the striker 10 to drive the latch bolt 11 clockwise 18 under the camming action of the indentation 12, until it is no longer detained by the striker 10. However, if the locking pawl 20 is allowed to engage the further notch 14, at a so-called half latch position, then the door can be half latched, partially open.

The locking pawl 20 is mounted pivotally at 21, and pivot points 15 and 21 are both fixed to a latch housing (not shown). The pawl 20 has an end tooth 24 for locking engagement in notches 13, 14. At the same end, it is formed with a pin 23 on which there is pivotally mounted a link arm 25 which is coupled to a door handle for actuating the pawl. Lifting the door handle causes the link arm 25 to move in the direction shown by arrow 26, pulling the pawl 20 anticlockwise as shown by arrow 22, and moving the pawl to its unlocking position (not shown).

In accordance with the present invention, the latch bolt 11 is coupled drivingly to an electric drive motor 70, of the type commonly used for the central locking of vehicle doors. This coupling arrangement, to be described in greater detail below, also incorporates an arrangement for releasing the pawl.

The motor 70 is coupled to the latch bolt 11 through gears 40, 50, 60. Gear 40, shown in isolation in FIG. 12, meshes at 45 with teeth 16 on the latch bolt 11. It is mounted for rotation about axis 42, which is shared by the larger-diameter gear 50, shown in isolation in FIG. 13. Gear 50 is drivingly coupled to gear 40, with 60 degrees of rotary free play, by means of a pair of slots 52, 53 in one of the plates of gear 50, through which slots project a pair of driving pins 44, 43 connected to gear 40. This 60° free play is important, in this embodiment, to allow for proper sequencing of the pawl release and latch bolt drive.

Rotary motion of gear 50 in the direction shown by arrow 41 is controlled by its direct meshing engagement with the spindle of the motor 70. In the embodiments shown in FIG. 11, this coupling is through the meshing of gear 71 on the motor spindle and teeth 62 on crown gear 60, gear 60 being connected to a smaller-diameter gear 61 which drives teeth 54 on gear 60. In the alternative embodiment shown in FIG. 13, worm gear 72 is driven directly by the motor spindle, and drives gear 50 directly.

One section of gear 50 has a U-shaped indentation 51 which earns against a limb 33 projecting from a hook 32 at the end of a pawl actuator 30. The actuator 30 is constrained by formations on the latch housing (not shown) to reciprocate generally I the direction shown by arrow 34 in FIG. 11, so as to link mechanically with pin 23 of the pawl 20. The upper end of the pawl actuator 30 is shaped as a dog leg with an extension formed with a slot which surrounds the pin 23. This arrangement provides free play in the driving connection between the pawl actuator 30 and pawl 20.

The operation of the power-assisted door latch will now be described. It will be appreciated that the door latch can be operated either mechanically, without motor power, or else under motor power. This of course is an important safety feature.

Powered operation will be described first. With the door in its closed position, as shown in FIG. 11, the latch bolt 11 is at its latching position, and the locking pawl 20 at its locking position. Pawl actuator 30 is engaged by the gear 50. Upon receipt of a command to open the door, form the central electronic control circuit 90, the motor 70 drives the gear 50 anticlockwise as shown at 41. For the first 60° of rotation, the gear 40 will remain stationary, and no attempt is made t rotate the latch bolt 11. Otherwise, the latch and pawl would jam. The indentation 51 pushes the pawl actuator 30 in the direction of arrow 34, and this immediately pushes against pin 23 and drives the pawl anticlockwise as shown by arrow 22, to move it to its unlocking position. Continued rotation of gear 50 cams out the extension 33 of the pawl actuator 30, so that it rests on the outer periphery of gear 50, and is temporarily prevented from re-entering. Continued rotation past the first 60° causes the walls of slots 52, 53 to engage the pins 44, 43 of the smaller gear 40, which drives the latch bolt 11 in the direction shown by arrow 18. With powered operation in this way, half latching is deliberately prevented. Thus the latch bolt is rotated so that notch 14 passes tooth 24, and until the outer surface of latch bolt 11 engages tooth 24 the pawl 20, preventing re-entry of the pawl.

Electronic position sensors, to be described below, cause the motor drive to switch off at the point that the vehicle door is partially open, and has passed its unlatched position. The door can then conveniently be opened fully by the passenger or driver.

Driving the latch bolt 11 clockwise has the desirable effect of pushing the door open, by reacting against the striker 10. This accelerates opening movement of the door, and such opening movement will continue until it is decelerated by friction in the door hinges by an amount dependent on the inclination of the vehicle.

When the door is closed, it will reach the same position, just beyond the half latch position, and will then cause the electric motor to be switched on again, with reverse polarity (to be described below). The motor then provides power-assisted door closing, to ensure that the door is properly closed and latched. Again, the half latch position is not possible, with power assisted closing. As the door commences full closure, anticlockwise rotation of the latch bolt 11 accompanies clockwise rotation of the smaller gear 40 together with the larger gear 50. After the first phase of such rotation, the extension 33 of the pawl actuator 30 translates back downwards. The free play between the pawl actuator and the pawl 20 allows the pawl 20 to ride over the slot 14 and into the slot 13, under a clockwise spring bias (not shown), without jamming. As the tooth 24 lodges in the slot 13, the arrangement returns to the position shown in FIG. 11.

Without power assist, the latch can be controlled by the door handle through the link arm 25. The mechanical interactions remain, and opening and closing the door causes rotation of the motor spindle, but this simply provides a small amount of mechanical resistance. Lifting the link arm 25 releases the pawl, allowing the door to be opened, whereby the latch bolt 11 is turned clockwise by striker 10.

Again, the pawl actuator 30 is released form engagement with the gear 50 until the door is reclosed. It will also be appreciated that since the mechanical sequence is the same, power assisted closing can follow non power assisted opening, and vice versa. When the latch is operated purely mechanically, it is capable of lodging in the half latch position, with tooth 24 of pawl 20 in notch 14. This is an additional convenience and safety feature.

A modification of the arrangement of FIGS. 2 and 10A, which provides door opening and closing, is shown in FIG. 14. As will be apparent, the abutment surface 231 on the shuttle 233 drives the pawl by way of its extension arm 232, moving it to position 232A. Continued motion in the same direction drives the latch bolt extension 37 to its unlatched position 37A. As with the arrangement of FIG. 10A, the notch 234 engages in link lever (1810 FIG. 10A) for electrical locking and unlocking.

An electric opening mechanism especially suitable for a boot or tailgate latch is shown in FIG. 15. The rotary output drive 50 of the motor 70 is coupled rigidly with a leadscrew 240 which causes linear reciprocating movement of a shuttle block 242 which is internally threaded in a nut portion 243 and which has an internal bore to receive the leadscrew 240. An end abutment surface of the shuttle 242 engages and drives the pawl 20 for door opening. As with other arrangements, a portion 244 of the pawl is connected by a link 245 to an external manual control such as a handle through a lever 246, to enable the door to be opened provided first the latch has been unlocked by a key mechanism, an interior door knob or an electrical control (not shown). The nut 243 and shuttle returns after each actuation to its neutral position, as shown, by at least one of the following mechanisms: a return spring acting on the nut; a return nut acting on the pawl; and repowering the motor so as to cause the nut to move in direction D6. The nut 243 is constrained to move linearly, by suitable means such as rails fixed to the housing.

In an alternative arrangement, the leadscrew 240 meshes with an internal thread 241 in the rotary drive gear 50, and the leadscrew is formed integrally with the shuttle 242. Further mechanical equivalent configurations will occur to the skilled reader.

A compact door latch arrangement is shown in FIG. 16. The housing 250 is in the form of a flat rectangular box with a rounded corner and a U-shaped opening for receiving the striker 10. The housing comprises mutually opposed end plates 252 and a side wall 251 defining an internal compartment 253 for housing the electric motor 70 and rotary output gearing 50. Cables 256, 258 for controlling respective levers 255 and 257 project through the side wall and are connected to the levers 255 and 257 project through the side wall and are connected to the levers by nipples held within end formations. The particular connection which his preferred is described below with reference to FIG. 16.

It is especially important for the compactness of this arrangement that several components are all mounted on the same pivot axes 21, including the pawl 20. This latch arrangement provides electric locking and unlocking.

The pawl 20 has a lever arm formed with a fork 259 to enable it to be driven rotationally. A pawn release lever 255 is pivotally connected on the pawl axis 21, for actuation by an external manual control such as an interior or exterior door handle. Rotary motion of the pawl release lever 255 is transmitted to the pawl fork 259 only by means of a rotary coupling member 300, 400 which carries a dependent elongate lug 262 disposed parallel to the pivot axis. Clockwise actuation of the pawl release lever 255 causes its end notch 263 to engage the lug 262, which is then driven against the fork 259. This leads the pawl 20 to its unlatching position, to allow the door to open.

The rotary coupling member 300, 400 comprises two components connected pivotally at the pivot axis 21 but capable of sliding movement, normal to the pivot axis, by virtue of an oval slot formed in both components 300, 400. Locking member 300 is constrained to move linearly between the left-most position as shown in FIG. 16, at which the door is unlocked, and a right-most position at which the door is locked because the pawl release lever 225 is no longer coupled to the pawl 20, i.e. it is rendered neutral. A rotary sliding member 400 has an arcuate slot which rides over the pin 301 on the locking member 300, and is integrally formed with the dependent lug 262. The slot is sufficient to allow the rotary sliding member to rotate with the pawl release lever 255 when they are coupled by virtue of the lug 262. When the locking member 300 is moved rightwards to its locking position at which it neutralises the pawl release lever, the lug 262 is moved with it, so that it can no longer be engaged by the notch 263 of the pawl release lever.

The rotary coupling member 300, 400, is driven selectively by an output disc 500 with an eccentric pin, driven by the bevel gear 50 of the motor 70. The pin drives the locking member 300 through a notch or other formation 302. Such coupling arrangements will be described in greater detail, in various alternative forms, with reference to FIGS. 17–20, 25–26.

Mechanical locking and unlocking is achieved through lever 257, for example from a key mechanism or interior door knob. This drives the locking member 300 and forces the electric motor drive when it is not powered. Thus the latch arrangement provides independent mechanical and electric locking and unlocking.

A member 254, of which only a portion is shown, also couples drivingly with part of the locking member 300, for locking and unlocking.

The rotary sliding member 400 with the lug 262, which is permanently coupled with the fork 259 of the pawl 20, is prevented from moving between its locking and unlocking positions for as long as it is in the course of being actuated rotationally, by means of a boss or elongate block 260 projecting from the housing. Whilst the fork 259 rides over the boss 260, the lug 262 cannot move radially of the pivot axis 21 past the boss 260, in either radially direction.

Anti-slam Locking

The boss 260 also has the desirable function of providing anti-slam locking of the latch. The boss 260 prevents inadvertent locking of the door whilst the door handle is held open and the pawl is in its unlatching position, by preventing sliding movement of the locking member 300, due to the radial engagement of lug 262 with boss 260. Thus if the door latch were unlocked and the door then slammed shut, the door could not inadvertently be locked, since the rotary coupling member 300, 400 is held within the housing.

Even without such locking arrangement with the boss 260, the latch arrangement can be configured for anti-slam locking. In the configuration shown in FIG. 16, and also in the arrangements of FIGS. 17 and 18, the locked position of the locking member 300 is to the right-hand side, away from the striker 10. The orientation of the latch bolt is such that the door closes in the leftwards direction. Thus, if the latch is unlocked before door closing, the locking member 300 will be fully to the left, and any impact upon slamming the door will have no effect on its position. If however, the door is locked and the door is then slammed, the locking member 300 may be forced, under the impact, to continue its motion leftwards to the unlocking position, and it may rebound to its locking position, but either way there would be no inadvertent movement from an unlocking to a locking position. Thus, the orientation of the latch bolt and the path of the coupling member 300 are such that, in use, the locking position is substantially further than the unlocking position of the coupling member 300 from the striker 10.

Selective Electric Locking

Two alternative latch arrangements for electrical locking and unlocking will be described with reference to FIGS. 17 and 18. Each arrangement has two pawl release levers 700, 800 for connection to external manual controls such as interior and exterior door handles, and each corresponding generally to the pawl release lever 255 described above with reference to FIG. 16. Each pawl release lever is selectively coupled to the pawl 20 by its own rotary coupling member 300, 400 and 350, 450 respectively. Each such rotary coupling member comprises a locking member 300, 350 connected respectively to a rotary sliding member 400, 450 which have analogous functions to the corresponding components described above with reference to FIG. 16. They are all disposed around the common pivot axis 21, providing maximum compactness and simplicity, and enabling the pawl release levers to have sufficient leverage over the pawl to be accommodated within the housing.

In addition, each latch arrangement has a further lever 900 connected to an external control mechanism through a cable 901, such as to a child-safety switch, or an interior door knob, depending on whether the arrangement is to be used in a rear door or a front door. This further lever 900 has a pivot point at 902 within the housing, and is connected to a lever arm with an end pin 903 coupling with an appropriate one of the rotary coupling members.

In the arrangement of FIG. 17, the locking members 300 and 350 have respective projecting pins 304 and 354 which engage with a cam pin 501 on the rotary indexing and driving member 500. In FIG. 17, the locking members are driven independently in opposite directions, whereas in the arrangement of FIG. 18 they may be driven together, to reciprocate in the directions D7 and D8, although they may alternatively be driven independently. The latch arrangements of FIGS. 17 and 18 are sufficiently flexible to be adapted for use with child-safety locking and/or panic door opening, and enable selective engagement of either or both exterior door handles. They may also be integrated with electric locking, controlled by the same electric motor or by a different motor.

In the case of FIG. 17, for example, for use in front doors, the exterior door handle would be connected to pawl release lever 700 through cable 701, and would be lockable by the interior door knob through lever 900. The interior handle would drive lever 800. For the rear doors, however, the connections with the door handles would be reversed, and lever 900 would be redundant or else could be used as a mechanical child safety lever.

The arrangement of FIG. 17 operates as follows. Rotary coupling member 300, 400 drives lugs 410 and 420 between a left-most position, as shown, and a right-most position at which lug 420 is free of notch 803 and lug 410 is free of notch 453. Lug 420 permanently engages in the jaw of the fork 259 on the pawl 20.

Rotary coupling member 350, 450 has a lug 451 on the left-hand side which is capable of being driven clockwise by notch 702 on pawl release lever 700. As mentioned above, it is also coupled pivotally to lever 900 through pin 903. The rotary sliding member 450 is formed with a notch 452 capable of being driven clockwise by a lug 802 on the pawl release lever 800. It is also formed with the notch 453 which drives lug 410 of other rotary sliding member 400, when at its left-most position.

Thus actuation of lever 700 drives the pawl through lugs 451 and 420 only in the position shown. If the rotary sliding member 450 were to be moved to the let, then lug 451 would no longer couple with notch 702, and lever 700 would be neutralized.

Actuation of lever 800 through notch 803 drives the lug 420 directly, but only if the rotary sliding member 400 is at its left-most position as shown. This in turn drives the pawl 20.

Wherever the rotary coupling member 350, 450 is at its neutral, left-most position (not shown), neutralizing lever 700, it is automatically returned to its coupling position, as shown, by the action of the other release lever 800 with its lug 802 acting on the notch 452 of rotary sliding member 450. Thus if for example the exterior door handle is operated on a door latch in which the interior door handle has been neutralized by a child-safety lever, subsequent operation of the interior door handle serves to open the door; in other words, operation of the exterior handle overrides the child-safety function. Similarly, this arrangement provides for a panic override of door locking, enabling lever 800 to raise the interior door knob coupled to lever 900 when an interior front door handle is operated.

The arrangement of FIG. 18 is operated analogously to that of FIG. 17 except that both rotary sliding members 400, 450 co-operate with the pawl fork at the right-hand side of the arrangement. Corresponding parts are denoted with the same reference numerals. FIG. 18A shows schematically the detailed arrangement at the right-hand side.

These arrangements avoid the need for a mechanical child-safety lever, since the selective operation of an interior door handle can be controlled electrically form an electronic central control unit. The use of the exterior door handle as a mechanical override allows the interior handle to be opened, and this is useful for police vehicle use as well as for child safety.

The arrangements also enable double locking to be achieved, by rendering neutral the interior door knob connected to lever 900 in FIG. 17, for example. Thus a single electric motor is capable of controlling double locking, selective locking of interior and exterior handles, and child-safety control. Electrical child safety locking is possible even without any separate mechanical arrangement, by virtue of the selective independent control of the interior door handle.

Existing door latches require a number of mechanical units for double locking, and often employ two motors.

Continuation of Locking or Unlocking Function After Temporary Blocking by Mechanical Door Handle Actuation Pawl release lever 700 of FIGS. 17 and 18 is shown in its neutral position 700A and its fully actuated position 700B in FIG. 19. When actuated, at position d the lug 420 of the corresponding rotary coupling member is capable of being driven only partially from its unlocking, neutral position 420A towards its fully locking, coupling position 420C. This is because the lug abuts at 420B against the edge of the lever 700. Once the door handle is released and it returns to position e, with the notch raised to position 702A, the lug 420 is free to move from position 420B to its fully coupling position 420C. In order to achieve this continued motion leftwards from B to C, even after an initial attempt which was blocked, the electric motor could be repowered, under the control of the central locking control unit 90. However, an alternative mechanical arrangement is to provide a mechanical resilient bias which directs the lug from 420B to 420C. Preferably, there is an over-centre spring arrangement whose centre position of instability corresponds to the halfway position of the lug between positions 420A and 420C which is slightly to the right of the intermediate position 420B at which it engages the lever 700. Thus the lug is biased to the right until it has moved to its midway position; beyond its midway position it is biased to the left. Such over-centre spring arrangements are well known, and typically employ a torsion spring whose ends are connected respectively to the lug and to the housing.

An alternative configuration for the rotary sliding members 400 and pawl 20 of FIGS. 17 and 18 is shown in FIG. 20. The fork is formed on the rotary sliding member 400, with fork arms 430 and 431 of different length, instead of being on the pawl. The pawl is formed with a downwardly depending pin 20A engaging in the fork. This facilitates separate sealing or isolation of the rotary coupling member and levers, which may be sealed jointly with the drive gear and motor. The pawl and latch bolt may be more easily separated from this sealed assembly, with the arrangement of FIG. 20, because the pin 20A can pass through a sealable opening in the housing over the pivot 21. This can achieve better sound proofing and can improve the life of the latch actuator by excluding grit and other abrasive materials.

A separate electric motor 70 drives a lever 194 pivoted at 195, by way of a sliding block 191 to which it is pivoted at 192 through a slot 193. The block 191 is constrained to move linearly and is driven by a leadscrew 198 driven by the motor through reduction gearing. The lever 194 at its pivoted end has a pin 196 connected to an actuation lever 197 capable of reciprocating linearly in directions D3 and D4 between positions c and d, to operate the child-safety mechanism. This couples the mechanism to the pawl selectively, as described above, for selective decoupling of the interior door handle. The electrical control avoids the need for a mechanical child-safety lever or switch in the rear door latch.

Combined Electrical Locking and Door Opening and Closing

The arrangements shown in FIGS. 21 and 27 enable a single electric motor to control independent functions for the latch arrangement, such as electric door locking and unlocking (central locking) and door opening and/or closing. Several independent innovations are disclosed, as with the other arrangements.

The latch arrangement in FIG. 21 has a rotary indexing and driving member 50 with a single cam pin 30 having two neutral positions Np1 and Np2, and spring biased into those positions by spring 1009 which also absorbs shock. Controlled operation in directions D1 and D2 causes independent actuation of a lever arm 1001, for door locking, and cam finger 1004 of a shuttle mechanism 1006. Electric locking is achieved by rotating the lever 1001, against its return torsion spring 1002, in directions D11 or D12, appropriately to actuate the pair of locking members 300 and 350 together. As shown, the cam 1003 of lever 1001 rotates from a neutral position C to either extreme positions C1, C2, depending on the rotary direction of the cam pin 30.

Door opening is achieved by the shuttle 1006 which has an abutment surface 1005 acting on the lever 1008 of pawl 20. Door closing is achieved by the abutment surface 1010 at the lower end of the shuttle which abuts against the latch bolt extension 37 to move it form position B to position B1. As shown, the cam finger 1004 moves between a neutral position Np and extreme positions P1 and P2. As before, the shuttle is controlled by a tension compression coil spring 1007.

The arrangement of FIG. 22 shows how a single cam finger 1012 on the rotary indexing and driving member 50 selectively controls three functions: the single lever 1001 of FIG. 21 is replaced by two such levers 1010, 1011, equi-angularly disposed around the rotary member 50. The cam finger 1012 has three neutral positions Np1, Np2 and Np3, to which it is spring biased by means not shown. This enables the independent control of the two locking members 300 and 350 as shown.

A further variant is shown in FIG. 23 in which a fourth actuation member is selectively driven by the cam finger 1012, and the four actuation members 1020 to 1023 are equi-angularly disposed around the rotary member 50. This enables a single electric motor to control the selective locking of two handles and electric door opening and closing, as in FIG. 22, and auxiliary function, such as a child safety operation. In a variant of the arrangement of FIG. 23, not shown, different cams 1012 could be disposed in different planes spaced axially of the rotary member 50, as on a cam shaft, to increase the flexibility of the multiple actuations.

A further variation is shown in FIG. 24, especially suitable for use with a tailgate or boot latch. The single cam pin 30 selectively drives pawl 20 through a rotary lever 1030 mounted co-axially with the pawl, and arranged with a dependent flange 1031 to drive the pawl in direction D3, but to rotate in direction D7 freely without actuating the pawl. Thus the cam pin 30 is able to rotate clockwise in direction D6 to rotate the lever 1030 without being hindered by the pawl. The cam pin also actuates a lever arm 1034 for operating the locking member 300 which is also coupled to the key mechanism through link 1033. The lock mechanism selectively couples the handle or knob through linkage 245 to the pawl 20.

As with other arrangements, the rotary member 50 may be spring biased into its neutral positions for example by a sinuous rotary cam surface against which the leaf spring 1037 is forced radially.

FIG. 25 illustrates how the cam pin 30 can be arranged to drive two sliding locking members 300 and 350 through appropriate pins or projections 304 and 354 respectively. Projection 354 is moveable by the cam pin 30 between positions A. A1, A2, and A3; projection 304 is correspondingly moveable between positions B, B1, B2, and B3. The stable positions of the projections 304, 354 are those positions on the broken line, shown as A1, A2, and B1, B2, and they are displaced between those positions by the cam pin 30 and they return to those positions after the passage of the cam pin 30. In order to allow the passage of the cam pin 30, they are resiliently moveable outwardly to the corresponding extreme positions A, A3, B and B3. By way of example, the resilience is achieved, as shown in FIG. 26, by arranging for the projection on the locking members 300, 350 to take the form of a toggle 1050 pivoted at 1052 and biased into its central position by torsion spring 1053 disposed on the pivot and held by fixed block 1054. The toggle or finger 1050 can be displaced rotationally to position P1, to be returned to its neutral position P, by spring arm 1051. Similarly, it can be displace to position P2 to be returned to its neutral position by spring arm 1055.

Alternative resilient formations are of course possible. The cam pin 30 may be fixed, and rides over a V-shaped leaf spring 1070 retained within a box formation in actuator 1080 which is part of one of the locking members, for example. Alternatively, a pin or button 30 is mounted for sliding movement in the housing either of the actuator of the rotary member 50, so that it can be depressed to allow the passage of the co-operating cam.

In the arrangement shown in FIG. 29, a rotary cam 1083 engages flexible elongate arms 1081 and 1082, capable of resiliently deforming in the radial direction of the rotary member 50 to allow the passage of the cam 1083 after actuation phase of rotation.

Housing for Latch Actuator

As described above, the latch actuator can be formed in a compact box-shaped housing. As shown in FIG. 27 the housing can be formed from two opposed end plates 3017 and 3018 together with a side wall 3027. This arrangement can be secured to the door frame 3023 by appropriate bolts 3024, 3025 and 3026 screwing respectively into an axis 3019, the pivot axis 21 for the pawl 20 and other mechanisms 3020, 3021 and 3022, and the pivot axis 15 for the latch bolt 11. These pivot axes 21 and 15 have axial upward projections extending through the face plate 3017, and include radial enlargements 3015 and 3028 respectively.

An elongate closure plate 3010 has keyhole-shaped apertures 3012 and 3013, coupling with the projecting pivot axes 3015 and 3028. During manufacture, once the latch arrangement components have been assembled as shown, and the face plate 3017 inserted over the three spindles, the closure plate 3010 is located with the larger circular portion of each keyhole 3012, 3013 passing over the enlargements 3015, 3028. At this point, a corresponding aperture 3011 in the closure plate is slightly misaligned with the axis of the spindle 3019 as shown. The closure plate 3010 is then slid, in direction A, over the face plate 3017, to lock it into position. The inner portions of each keyhole slide over and retain the respective spindles on the pivot axes 21 and 15. The closure plate then bears against the enlargements or studs 3015 and 3028. At this point, aperture 3011 in the closure plate reaches the axis of the spindle 3019, and a closure cap 3014 is inserted with a push fit through aperture 3011 and a corresponding aperture in the face plate 3017, to secure the closure plate against sliding movement.

This arrangement allows non-destructive disassembly of the latch arrangement, simply by removing the cap 3014 sliding the closure plate 3010 and then removing the closure plate and disassembling the remainder of the latch assembly. Thus faulty components can be replaced at any time.

Each end of the latch housing may have its own such closure plate.

What is claimed is:

1. A latch arrangement for engaging an automotive door having a handle to a striker, comprising:

only one electric motor;

a latch bolt displaceable between a latched position at which it engages the striker and an unlatched position at which it releases the striker;

a pawl operative to selectively latch and unlatch the latch bolt;

a driving and indexing member coupled to and driven by the motor and having at least one projection extending therefrom;

at least one pawl release member selectively engageable to the pawl for causing it to unlatch the latch bolt and configured to be engaged drivingly to the door handle;

at least one coupling member associated with the pawl release member and arranged to be driven by the projection selectively between a locking position at which the coupling member disengages the pawl release member from the pawl such that movement of the pawl release member is not conveyed to the pawl, and an unlocking position at which the coupling member engages the pawl release member with the pawl to enable the door handle to drive the pawl release member to release the pawl from the latch bolt; and an actuation member independent of the coupling member and coupled to the pawl for causing it to unlatch the latch bolt and arranged to be independently driven by the projection;

whereby the driving and indexing member is drivable in sequence electrically first to cause the projection to drive the coupling member to the unlocking position at which the coupling member engages the pawl release member with the pawl, and then, later in the sequence, to drive the actuation member to cause the pawl to unlatch the latch bolt to open the door.

2. The latch arrangement according to claim 1, in which the latch bolt is selectively drivingly coupled to the driving and indexing member, independently of the coupling member and the actuation member, such that continued motion of the driving and indexing member in the sequence, beyond the position at which it drives the actuation member, causes it to drive the latch bolt, whereby the door may be drawn to a fully closed position under the power of the motor.

3. The latch arrangement according to claim 1, wherein the driving and indexing member is operable selectively in two opposite directions, and the projection is operative to drive the coupling member in corresponding opposite directions to change between the locking and unlocking positions thereof.

4. The latch arrangement according to claim 2, wherein the driving and indexing member is operable selectively in two opposite directions, and the projection is operative to drive the coupling member in corresponding opposite directions to change between the locking and unlocking positions thereof.

5. The latch arrangement according to claim 1, wherein there are at least two projections and two corresponding coupling members associated with the pawl release members, the projections being arranged to engage the corresponding coupling members at different stages of the sequence of movement of the driving and indexing member.

6. The latch arrangement according to claim 2, wherein there are at least two projections and two corresponding coupling members associated with the pawl release members, the projections being arranged to engage the corresponding coupling members at different stages of the sequence of movement of the driving and indexing member.

7. The latch arrangement according to claim 3, wherein there are at least two projections and two corresponding coupling members associated with the pawl release members, the projections being arranged to engage the corresponding coupling members at different stages of the sequence of movement of the driving and indexing member.

8. The latch arrangement according to claim 3, in which the driving and indexing member is spring biased to a central position from which it is drivable in either direction.

9. The latch arrangement according to claim 1, in which the driving and indexing member is rotary so that the said projection is driven rotationally.

10. The latch arrangement according to claim 1, further comprising a key-operable mechanism drivingly coupled to both of said coupling members for moving them both manually between locking and unlocking positions independently of the electric motor.

11. The latch arrangement according to claim 1, further comprising a door knob-operable mechanism drivingly coupled to one of said coupling members for moving it manually between its locking and unlocking positions independently of the electric motor.

12. The latch arrangement according to claim 2, in which the projection is arranged to sequentially drive the latch bolt directly.

13. The latch arrangement according to claim 2, in which the projection is arranged to sequentially drive the at least one coupling member, the actuation member and the latch bolt respectively and independently.

14. A latch arrangement for engaging an automotive door having a handle to a striker, comprising:

only one electric motor;

a latch bolt displaceable between a latched position at which it engages the striker and an unlatched position at which it releases the striker;

a pawl operative to selectively latch and unlatch the latch bolt;

a driving and indexing member coupled to and driven by the motor and having at least one projection extending therefrom;

at least one pawl release member selectively engageable to the pawl for causing it to unlatch the latch bolt and configured to be engaged drivingly to the door handle; and at least one coupling member associated with the pawl release member and arranged to be driven by the projection selectively between a locking position at which the coupling member disengages the pawl release member from the pawl such that movement of the pawl release member is not conveyed to the pawl, and an unlocking position at which the coupling member engages the pawl release member with the pawl to enable the door handle to drive the pawl release member to release the pawl from the latch bolt;

whereby the driving and indexing member is drivable in sequence electrically to cause the projection to drive the coupling member to the unlocking position at which the coupling member engages the pawl release member with the pawl and to drive the latch bolt whereby the door may be drawn to a fully closed position under the power of the motor.

* * * * *